US011605871B2

(12) United States Patent
Ogawa

(10) Patent No.: US 11,605,871 B2
(45) Date of Patent: Mar. 14, 2023

(54) RESONATOR AND FILTER

(71) Applicant: Soshin Electric Co., Ltd., Saku (JP)

(72) Inventor: Keisuke Ogawa, Otsu (JP)

(73) Assignee: Soshin Electric Co., Ltd, Saku (JP)

( * ) Notice: Subject to any disclaimer, the term of this patent is extended or adjusted under 35 U.S.C. 154(b) by 146 days.

(21) Appl. No.: 17/252,499

(22) PCT Filed: Jun. 12, 2019

(86) PCT No.: PCT/JP2019/023322
§ 371 (c)(1),
(2) Date: Dec. 15, 2020

(87) PCT Pub. No.: WO2019/244749
PCT Pub. Date: Dec. 26, 2019

(65) Prior Publication Data

US 2021/0159582 A1 May 27, 2021

(30) Foreign Application Priority Data

Jun. 20, 2018 (JP) ..... JP2018-116633

(51) Int. Cl.
*H01P 1/20* (2006.01)
*H01P 7/08* (2006.01)
*H01P 1/203* (2006.01)

(52) U.S. Cl.
CPC ..... *H01P 7/08* (2013.01); *H01P 1/20* (2013.01); *H01P 1/203* (2013.01)

(58) Field of Classification Search
CPC .. H01P 7/08; H01P 7/084; H01P 7/082; H01P 7/04; H01P 1/203; H01P 1/205;
(Continued)

(56) References Cited

U.S. PATENT DOCUMENTS 5,621,366 A * 4/1997 Gu ..... H01P 7/084 333/204
5,945,892 A 8/1999 Kato et al.
(Continued)

FOREIGN PATENT DOCUMENTS

CN 103986438 A 8/2014
JP H09-191206 A1 7/1997
(Continued)

OTHER PUBLICATIONS

Chinese Office Action (Application No. 201980041202.1) dated Jan. 18, 2022 (with partial English translation).
(Continued)

*Primary Examiner* — Stephen E. Jones
(74) *Attorney, Agent, or Firm* — Burr Patent Law, PLLC

(57) ABSTRACT

Provided are a resonator having a good Q value and a filter using the resonator. The resonator has: a via electrode portion formed inside a dielectric substrate; a plurality of shielding conductors formed on the dielectric substrate to surround the via electrode portion; a first strip line which is connected to one end of the via electrode portion in the dielectric substrate and faces a first shielding conductor among the plurality of shielding conductors; and a second strip line which is connected to the other end of the via electrode portion in the dielectric substrate and faces a second shielding conductor among the plurality of shielding conductors.

17 Claims, 32 Drawing Sheets

(58) Field of Classification Search
CPC .. H01P 1/20; H01P 1/201; H01P 1/202; H01P 1/2053; H01P 1/2056; H03H 7/0161; H03H 7/01
See application file for complete search history.

(56) References Cited

U.S. PATENT DOCUMENTS

| | | | | |
|---|---|---|---|---|
| 2003/0151476 | A1* | 8/2003 | Salmela | H05K 1/0219 333/245 |
| 2004/0000968 | A1 | 1/2004 | White et al. | |
| 2007/0085108 | A1 | 4/2007 | White et al. | |
| 2010/0244984 | A1* | 9/2010 | Fukunaga | H01P 1/2056 333/175 |
| 2010/0265015 | A1 | 10/2010 | Hoeft et al. | |
| 2017/0338031 | A1 | 11/2017 | Miyahara | |

FOREIGN PATENT DOCUMENTS

| | | | |
|---|---|---|---|
| JP | 3501327 | B2 | 3/2004 |
| JP | 2004-228891 | A | 8/2004 |
| JP | 2006-521775 | A | 9/2006 |
| JP | 2007-523574 | A1 | 8/2007 |
| JP | 2011-507312 | A1 | 3/2011 |
| JP | 2017-195565 | A1 | 10/2017 |

OTHER PUBLICATIONS

Japanese Office Action (Application No. 2020-126091) dated Oct. 5, 2021 (with English translation).
International Search Report and Written Opinion (Application No. PCT/JP2019/023322) dated Aug. 27, 2019.
Japanese Office Action (Application No. 2018-116633) dated May 26, 2020 (with English translation).
German Office Action (with English translation), German Application No. 112019003092.2, dated Nov. 7, 2022 (10 pages).

* cited by examiner

10

10

10

10

RESONATOR AND FILTER

TECHNICAL FIELD

The present invention relates to a resonator and a filter.

BACKGROUND ART

There has been proposed a resonator that includes: a strip line facing a shielding conductor formed on one principal surface side of a dielectric substrate; and a via electrode whose one end is connected to a shielding conductor formed on the other principal surface side of the dielectric substrate, and whose other end is connected to the strip line (Japanese Laid-Open Patent Publication No. 2017-195565, Japanese Patent No. 3501327, and Japanese Laid-Open Patent Publication No. 2011-507312 (PCT)). Such a resonator in which one end of the via electrode is connected to a shielding conductor may operate as a λ/4 resonator.

SUMMARY OF INVENTION

However, although the above-described kind of λ/4 resonator is effective for downsizing, current concentrates in a portion where the via electrode and the shielding conductor are contacting each other, that is, a short-circuit portion, during resonance. To deal with this, it is conceivable that, in order to eliminate concentration of current in the short-circuit portion and thereby improve a Q-factor, cross-sectional area of a current path be made larger. For example, it is conceivable for a via diameter to be made larger or for the number of vias to be increased. However, in the case of doing so, size of the resonator ends up increasing, and a requirement of downsizing of the resonator cannot be fulfilled.

An object of the present invention is to provide a resonator with a good Q-factor and a filter employing the resonator.

A resonator according to an aspect of the present invention includes: a via electrode portion formed inside a dielectric substrate; a plurality of shielding conductors formed in the dielectric substrate so as to surround the via electrode portion; a first strip line which is connected to one end of the via electrode portion and faces a first shielding conductor among the plurality of shielding conductors, inside the dielectric substrate; and a second strip line which is connected to another end of the via electrode portion and faces a second shielding conductor among the plurality of shielding conductors, inside the dielectric substrate.

A filter according to another aspect of the present invention includes a resonator of the above-described kind.

Due to the present invention, there can be provided a resonator with a good Q-factor and a filter employing the resonator.

DESCRIPTION OF EMBODIMENTS

Preferred embodiments of a resonator and a filter according to the present invention will be presented and described in detail below with reference to the accompanying drawings.

First Embodiment

Figure 1:
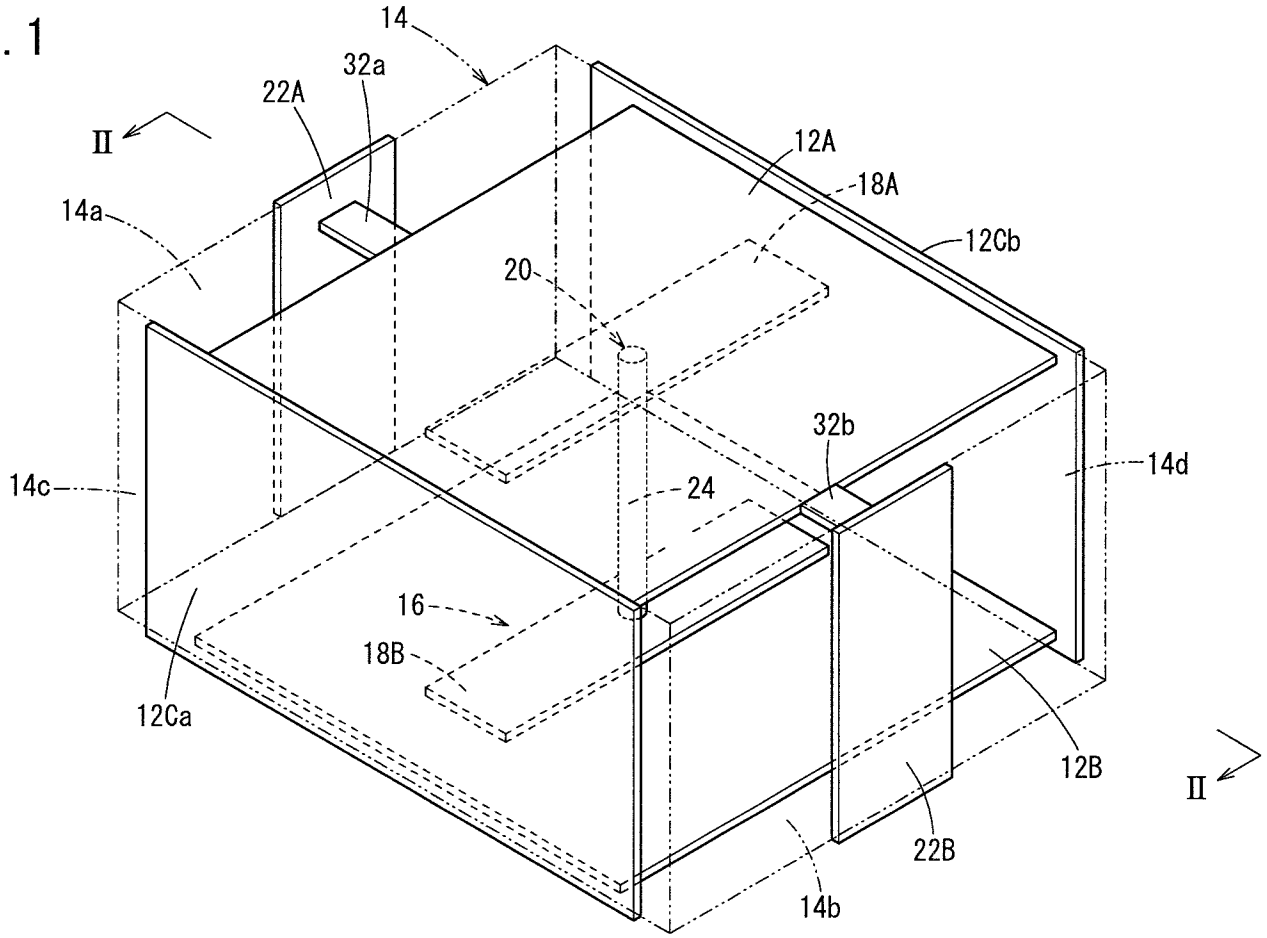
FIG. 1 is a perspective view showing a resonator according to a first embodiment.
Figure 2:
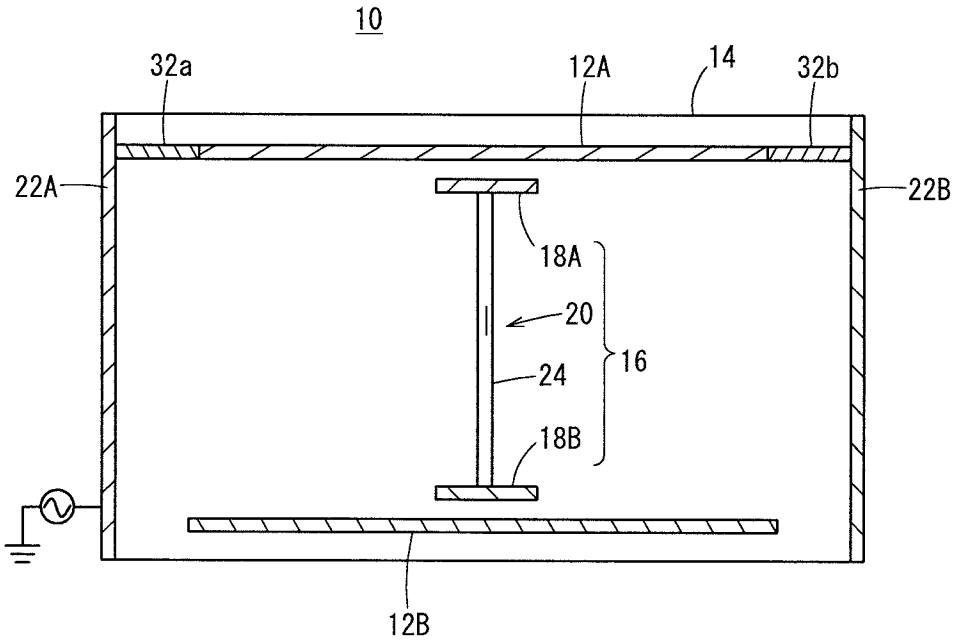
FIG. 2 is a cross-sectional view showing the resonator according to the first embodiment.
Figure 3:
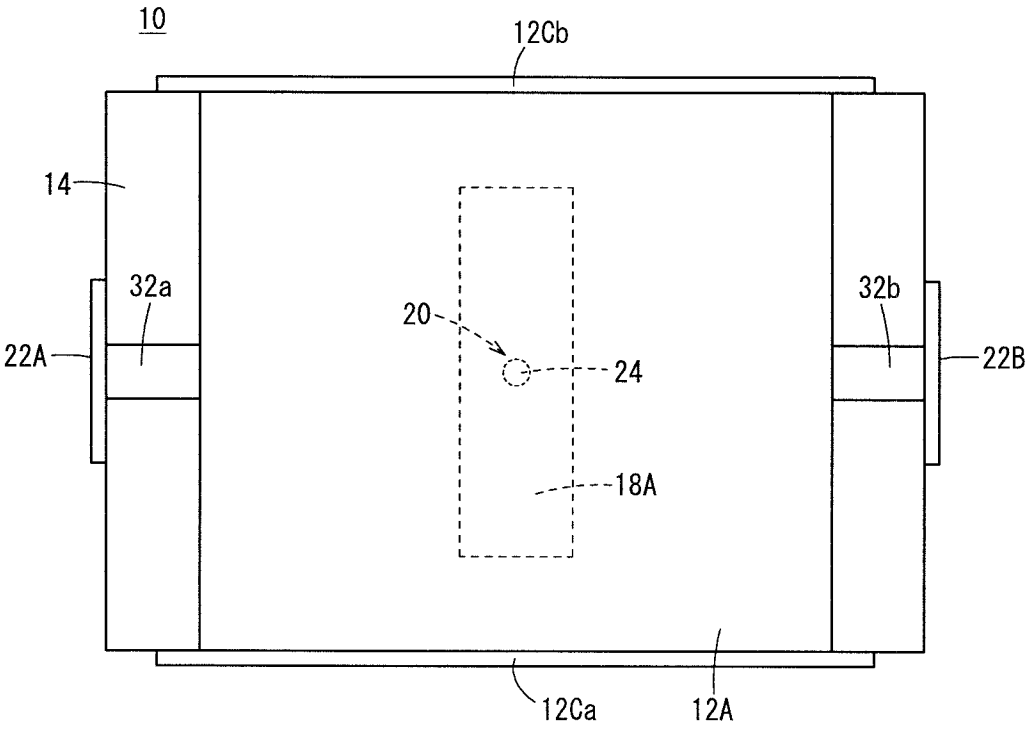
FIG. 3 is a plan view showing the resonator according to the first embodiment.

A resonator according to a first embodiment will be described using FIGS. 1 to 3. FIG. 1 is a perspective view showing the resonator according to the present embodiment. FIG. 2 is a cross-sectional view showing the resonator according to the present embodiment. FIG. 2 corresponds to the line II-II of FIG. 1. FIG. 3 is a plan view showing the resonator according to the present embodiment.

As shown in FIG. 1, a resonator 10 according to the present embodiment includes: a dielectric substrate 14 at least having respectively formed in its upper portion and its lower portion an upper shielding conductor 12A and a lower shielding conductor 12B; and a single structure 16 formed inside the dielectric substrate 14. The upper shielding conductor 12A is formed on one principal surface side of the dielectric substrate 14. The lower shielding conductor 12B is formed on the other principal surface side of the dielectric substrate 14. The structure 16 includes: an upper strip line 18A facing the upper shielding conductor 12A; and a lower strip line 18B facing the lower shielding conductor 12B. The structure 16 further includes a via electrode portion 20 which is formed inside the dielectric substrate 14, and is formed from the upper strip line 18A to the lower strip line 18B. Planar shapes of the upper strip line 18A and the lower strip line 18B are rectangular, for example.

The dielectric substrate 14 is configured by laminating a plurality of dielectric layers. The dielectric substrate 14 is formed in a parallelepiped shape, for example. A first side surface 14*a* among the four side surfaces of the dielectric substrate 14 has a first input/output terminal 22A which is formed thereon. A second side surface 14*b* facing the first side surface 14*a* has a second input/output terminal 22B which is formed thereon. A third side surface 14*c* among the four side surfaces of the dielectric substrate 14 has a first side surface shielding conductor 12Ca which is formed thereon. A fourth side surface 14*d* facing the third side surface 14*c* has a second side surface shielding conductor 12Cb which is formed thereon.

In the present embodiment, the via electrode portion 20 is configured by a single via electrode 24. The via electrode 24 is embedded in via holes formed in the dielectric substrate 14.

The upper shielding conductor 12A is coupled to the first input/output terminal 22A via a first connection line 32*a*. More specifically, the upper shielding conductor 12A is electrically continuous with the first input/output terminal 22A via the first connection line 32*a*. In addition, the upper shielding conductor 12A is coupled to the second input/output terminal 22B via a second connection line 32*b*. More specifically, the upper shielding conductor 12A is electrically continuous with the second input/output terminal 22B via the second connection line 32*b*.

The via electrode portion 20 and the first side surface shielding conductor 12Ca and second side surface shielding conductor 12Cb behave like a semi-coaxial resonator. Orientation of current flowing in the via electrode portion 20 and orientation of current flowing in the first side surface shielding conductor 12Ca are opposite, and moreover, orientation of current flowing in the via electrode portion 20 and orientation of current flowing in the second side surface shielding conductor 12Cb are opposite. Therefore, an electromagnetic field can be confined in a portion surrounded by the shielding conductors 12A, 12B, 12Ca, 12Cb, and loss due to radiation can be reduced and effects on outside can be reduced. At a certain timing during resonance, current flows so as to diffuse from a center of the upper shielding conductor 12A to an entire surface of the upper shielding conductor 12A. At this time, current flows in the lower shielding conductor 12B so as to concentrate from an entire surface of the lower shielding conductor 12B toward a center of the lower shielding conductor 12B. Moreover, at another timing during resonance, current flows so as to diffuse from the center of the lower shielding conductor 12B to the entire surface of the lower shielding conductor 12B. At this time, current flows in the upper shielding conductor 12A so as to concentrate from the entire surface of the upper shielding conductor 12A toward the center of the upper shielding conductor 12A. The current flowing so as to diffuse to the entire surface of the upper shielding conductor 12A or lower shielding conductor 12B similarly flows, as is, in the first side surface shielding conductor 12Ca and second side surface shielding conductor 12Cb too. That is, the current flows in a conductor of broad line width. In a conductor of broad line width, a resistance component is small, hence deterioration in Q-factor is small.

In the present embodiment, the via electrode portion 20 is not electrically continuous with either the upper shielding conductor 12A or the lower shielding conductor 12B. Electrostatic capacitance (open end capacitance) exists between the upper strip line 18A connected to the via electrode portion 20, and the upper shielding conductor 12A. Moreover, electrostatic capacitance exists also between the lower strip line 18B connected to the via electrode portion 20, and the lower shielding conductor 12B. The via electrode portion 20 configures a $\lambda/2$ resonator in conjunction with the upper strip line 18A and the lower strip line 18B. The resonator 10 according to the present embodiment may operate as a both end-opened type $\lambda/2$ resonator.

In the $\lambda/4$ resonator of the kind described in Japanese Laid-Open Patent Publication No. 2017-195565, Japanese Patent No. 3501327, and Japanese Laid-Open Patent Publication No. 2011-507312 (PCT), current concentrates in a portion where a via electrode portion and a shielding conductor are contacting each other, that is, a short-circuit portion, during resonance. The portion where the via electrode portion and the shielding conductor are contacting each other is a portion where a path of the current bends perpendicularly. There is concern that when current concentrates in a place where the path of the current bends greatly, a sufficiently good Q-factor may not necessarily be obtained. It is conceivable also that, in order to eliminate concentration of current in the short-circuit portion and thereby improve the Q-factor, cross-sectional area of the current path be made larger. For example, it is conceivable for a via diameter to be made larger or for the number of vias to be increased. However, in the case of doing so, size of the resonator ends up increasing, and a requirement of downsizing of the resonator cannot be fulfilled. In contrast, in the present embodiment, the via electrode portion 20 does not contact either the upper shielding conductor 12A or the lower shielding conductor 12B. That is, in the present embodiment, a both end-opened type $\lambda/2$ resonator is configured. Therefore, in the present embodiment, a local concentration of current is prevented from occurring in the upper shielding conductor 12A and the lower shielding conductor 12B, and meanwhile, current can be concentrated in a vicinity of a center of the via electrode portion 20. Since a place where current concentrates is the via electrode portion 20 alone, that is, since current concentrates in a place where there is continuity (linearity), the present embodiment enables the Q-factor to be improved.

In this way, in the present embodiment, the upper strip line 18A facing the upper shielding conductor 12A is connected to one end of the via electrode portion 20, and the lower strip line 18B facing the lower shielding conductor 12B is connected to the other end of the via electrode portion 20. Therefore, due to the present embodiment, sufficient current can be concentrated in the vicinity of the center of the via electrode portion 20, while preventing the local concentration of current from occurring in the upper shielding conductor 12A and the lower shielding conductor 12B. Hence, due to the present embodiment, a resonator 10 with a good Q-factor can be provided.

Modified Example 1

Figure 4:
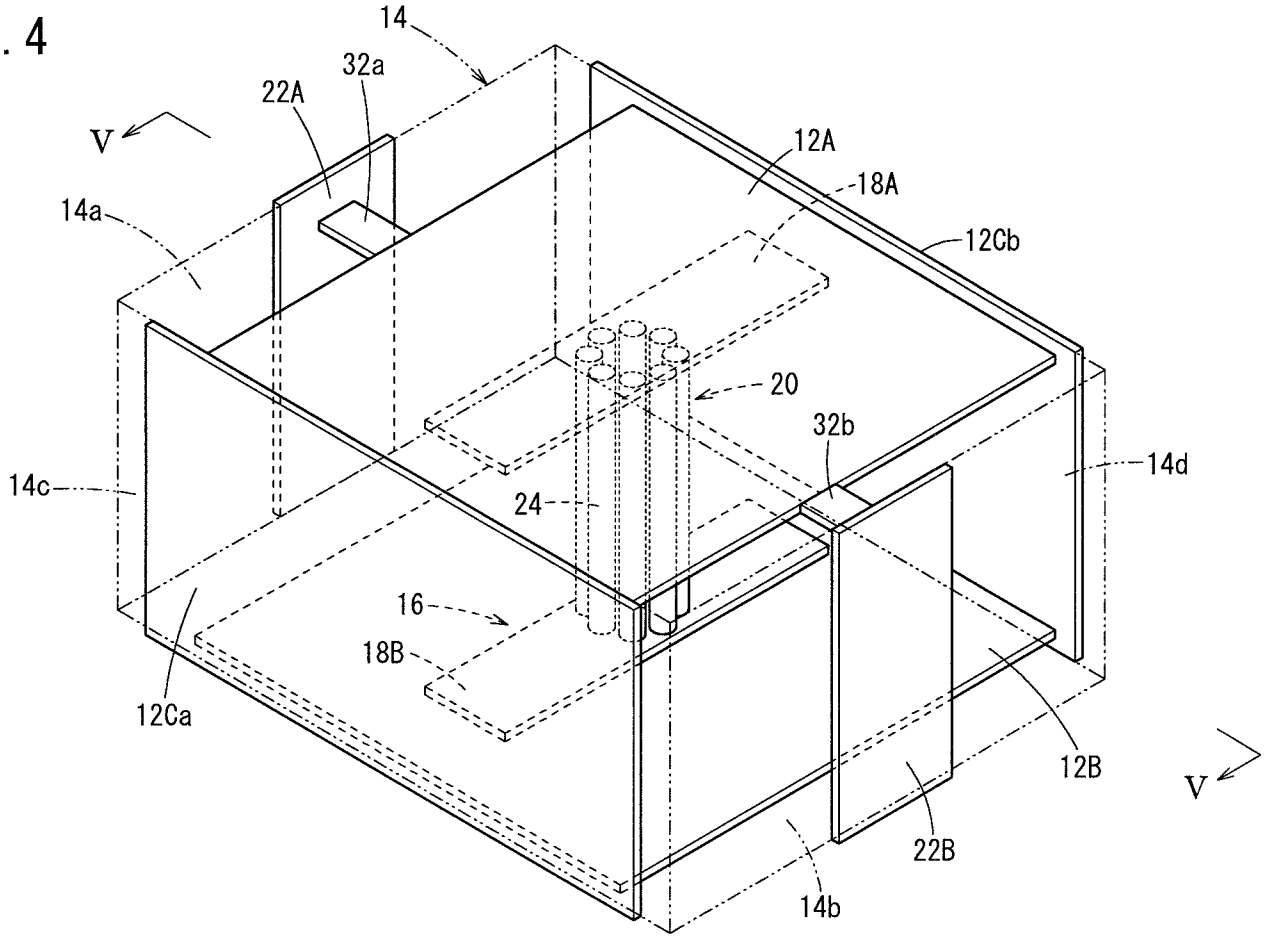
FIG. 4 is a perspective view showing a resonator according to modified example 1 of the first embodiment.
Figure 5:
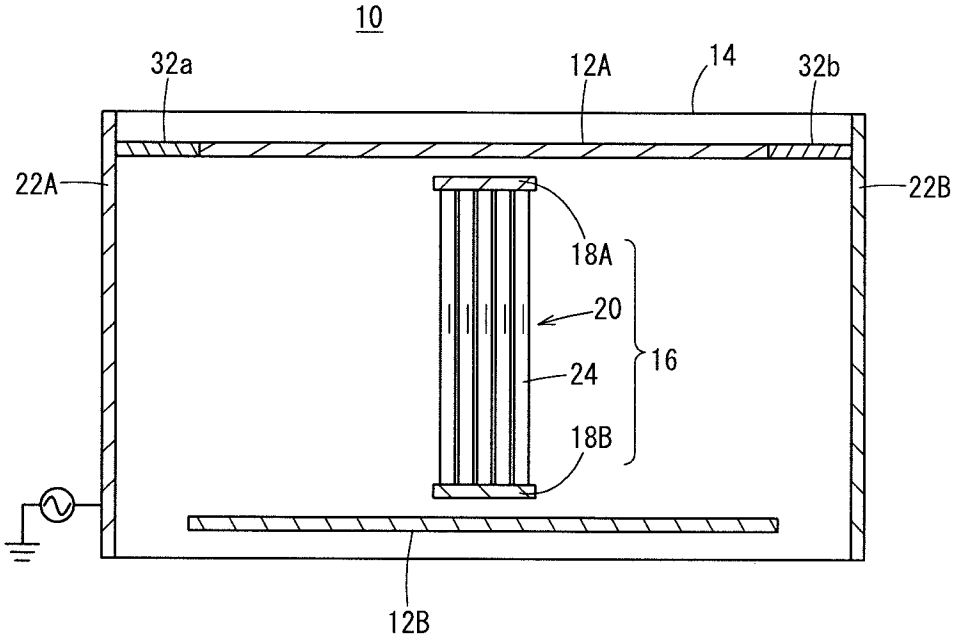
FIG. 5 is a cross-sectional view showing the resonator according to modified example 1 of the first embodiment.
Figure 6:
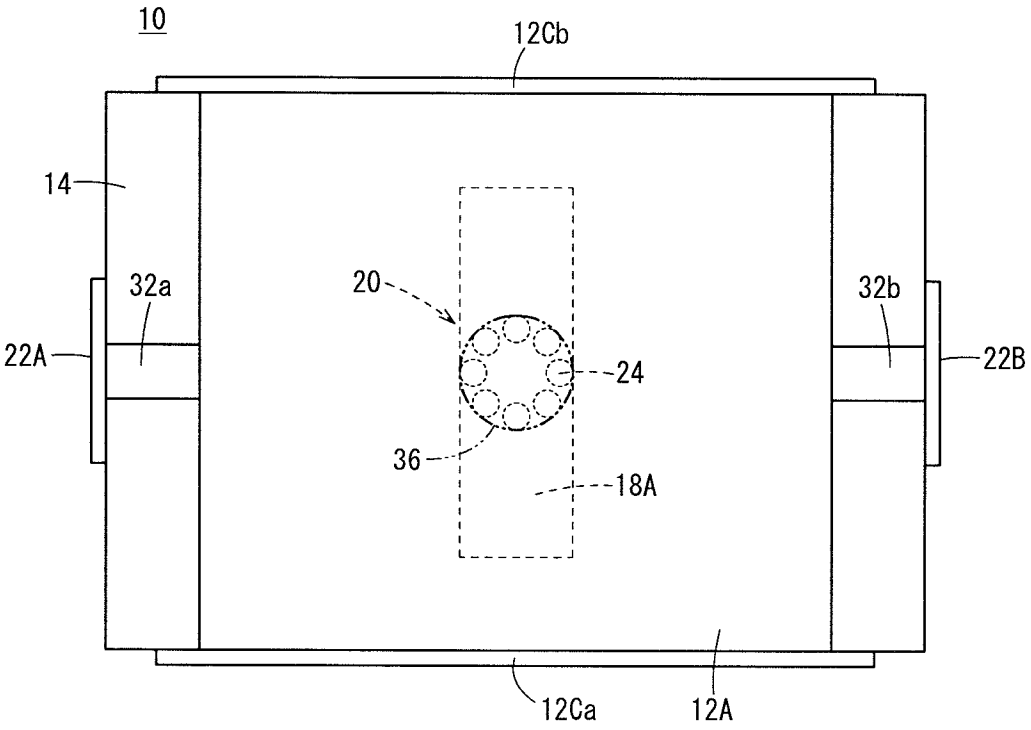
FIG. 6 is a plan view showing the resonator according to modified example 1 of the first embodiment.

A resonator according to modified example 1 of the present embodiment will be described using FIGS. 4 to 6. FIG. 4 is a perspective view showing the resonator according to the present modified example. FIG. 5 is a cross-sectional view showing the resonator according to the present modified example. FIG. 5 corresponds to the line V-V of FIG. 4. FIG. 6 is a plan view showing the resonator according to the present modified example.

A resonator 10 according to the present modified example has its via electrode portion 20 configured by a plurality of via electrodes, that is, a plurality of the via electrodes 24. The plurality of via electrodes 24 are arranged along an imaginary circle 36. In the present modified example, since the via electrode portion 20 is configured by the plurality of via electrodes 24 being arranged so as to lie along the imaginary circle 36, the via electrode portion 20 may behave like a via electrode of large diameter corresponding to the imaginary circle 36. In this way, the via electrode portion 20 may be configured by the plurality of via electrodes 24. Moreover, the plurality of via electrodes 24 may be arranged so as to lie along the imaginary circle 36.

Modified Example 2

Figure 7A:
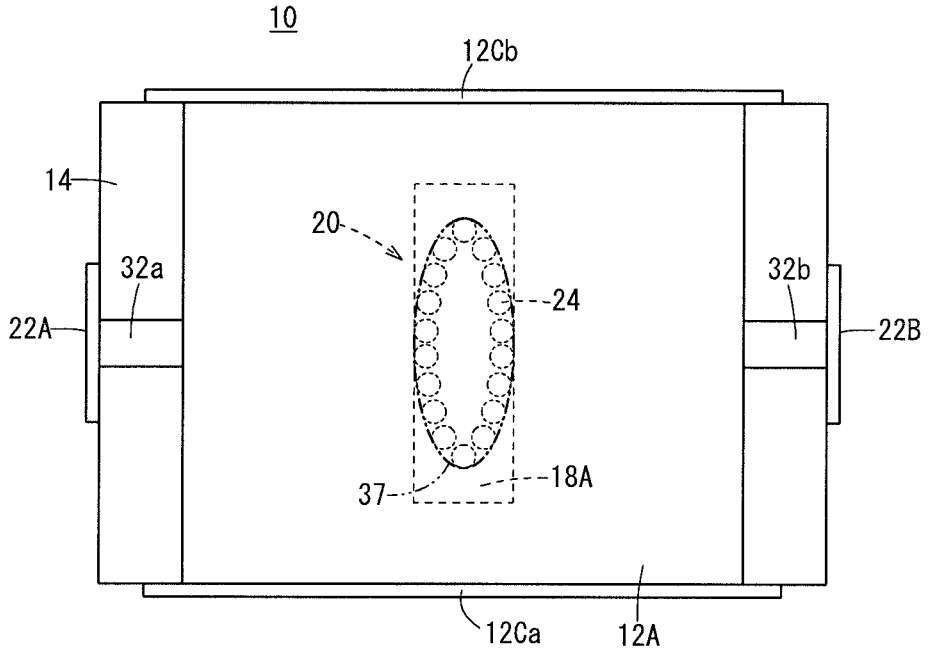
FIGS. 7A and 7B are plan views showing a resonator according to modified example 2 of the first embodiment.
Figure 7B:
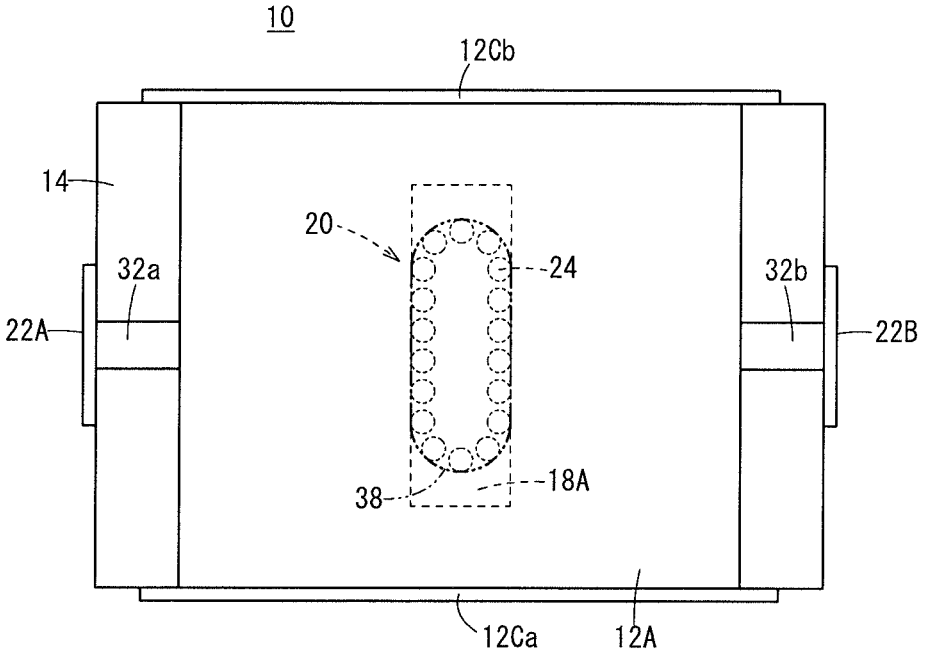

A resonator according to modified example 2 of the present embodiment will be described using FIGS. 7A and 7B. FIGS. 7A and 7B are plan views showing the resonator according to the present modified example. FIG. 7A shows an example where the plurality of via electrodes 24 configuring the via electrode portion 20 are arranged along an imaginary ellipse 37. FIG. 7B shows an example where the plurality of via electrodes 24 configuring the via electrode portion 20 are arranged along an imaginary track shape 38.

In the example shown in FIG. 7A, the plurality of via electrodes 24 configuring the via electrode portion 20 are arranged along the imaginary ellipse 37. In the example shown in FIG. 7B, the plurality of via electrodes 24 configuring the via electrode portion 20 are arranged along the imaginary track shape 38. The track shape refers to a shape configured from two semicircular portions that face each other and two parallel straight-line portions connecting these semicircular portions. In the present modified example, the plurality of via electrodes 24 configuring the via electrode portion 20 are arranged so as to lie along the imaginary ellipse 37 or the imaginary track shape 38. Therefore, in the present modified example, the via electrode portion 20 may behave like a via electrode of large diameter corresponding to the imaginary ellipse 37 or the imaginary track shape 38. In this way, the via electrode portion 20 may be configured by the plurality of via electrodes 24 being arranged so as to lie along the imaginary ellipse 37 or the imaginary track shape 38.

Modified Example 3

Figure 8:
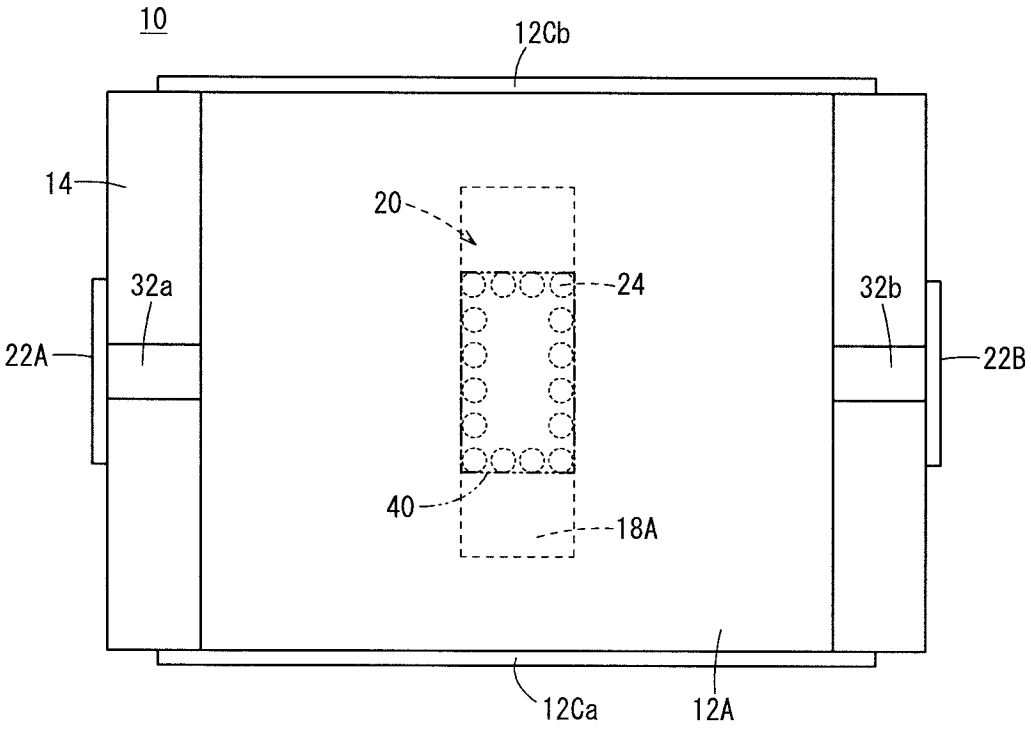
FIG. 8 is a plan view showing a resonator according to modified example 3 of the first embodiment.

A resonator according to modified example 3 of the present embodiment will be described using FIG. 8. FIG. 8 is a plan view showing the resonator according to the present modified example.

In the resonator 10 according to the present modified example, the plurality of via electrodes 24 configuring the via electrode portion 20 are arranged along an imaginary polygon 40 (for example, a quadrangle). In the present modified example, since the plurality of via electrodes 24 configuring the via electrode portion 20 are arranged so as to lie along the imaginary polygon 40, the via electrode portion 20 may behave like a via electrode of large diameter corresponding to the imaginary polygon 40. In this way, the via electrode portion 20 may be configured by the plurality of via electrodes 24 being arranged so as to lie along the imaginary polygon 40. The polygon may include a hexagon, an octagon, or the like, besides the quadrangle of the kind shown in FIG. 8.

Modified Example 4

Figure 9A:
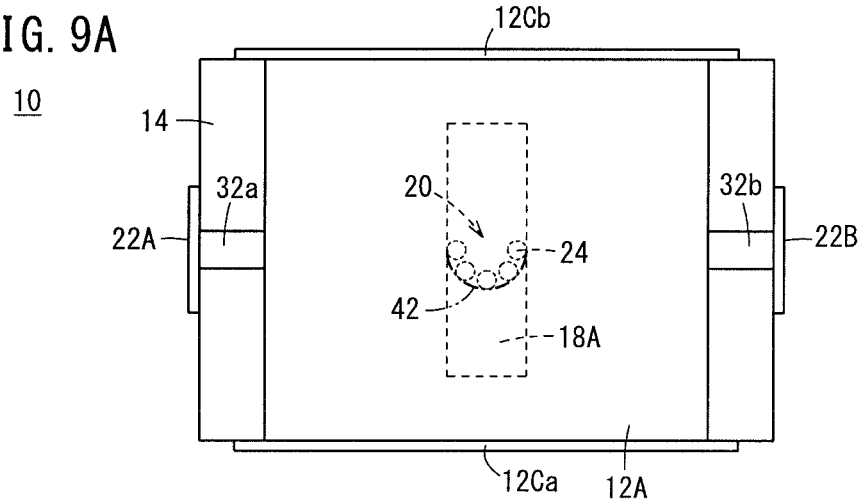
FIGS. 9A, 9B, and 9C are plan views showing a resonator according to modified example 4 of the first embodiment.
Figure 9B:
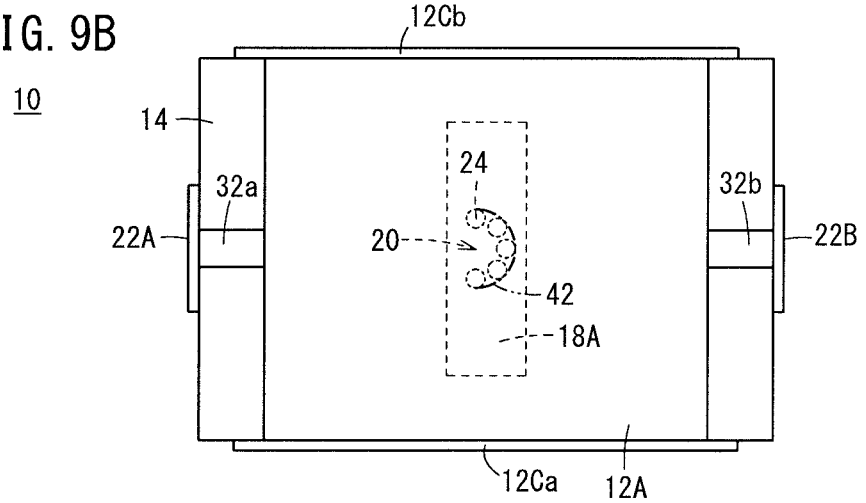
Figure 9C:
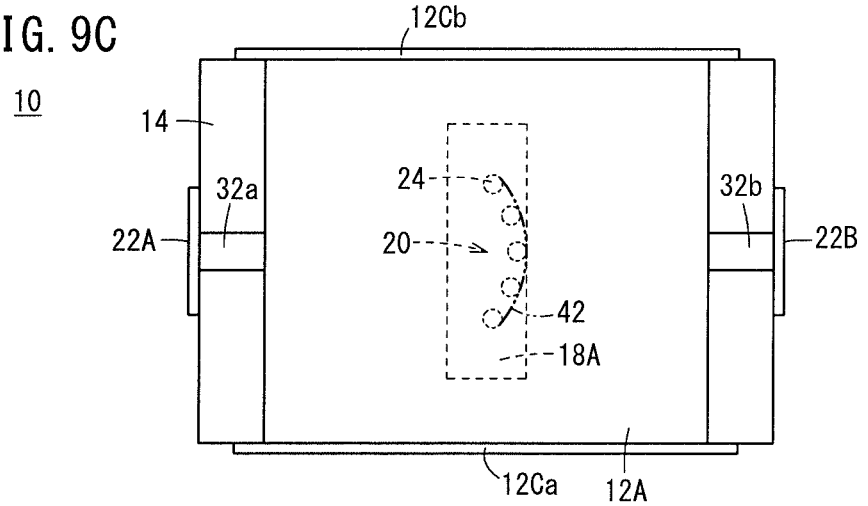

A resonator according to modified example 4 of the present embodiment will be described using FIGS. 9A to 9C. FIGS. 9A to 9C are plan views showing the resonator according to the present modified example.

In the resonator 10 according to the present modified example, the plurality of via electrodes 24 configuring the via electrode portion 20 are arranged along an imaginary circular arc 42. An inclination of the imaginary circular arc 42 is not particularly limited. FIG. 9B shows an example of the case where the inclination of the imaginary circular arc 42 has been rotated 90 degrees counterclockwise with respect to FIG. 9A. Moreover, a radius of the imaginary circular arc 42 is not particularly limited either. FIG. 9C shows an example of the case where the radius of the imaginary circular arc 42 has been set larger than in FIG. 9B. In the present modified example, since the plurality of via electrodes 24 configuring the via electrode portion 20 are arranged so as to lie along the imaginary circular arc 42, the via electrode portion 20 may behave like a via electrode of large diameter corresponding to the imaginary circular arc 42. In this way, the via electrode portion 20 may be configured by the plurality of via electrodes 24 being arranged so as to lie along the imaginary circular arc 42.

Modified Example 5

Figure 10:
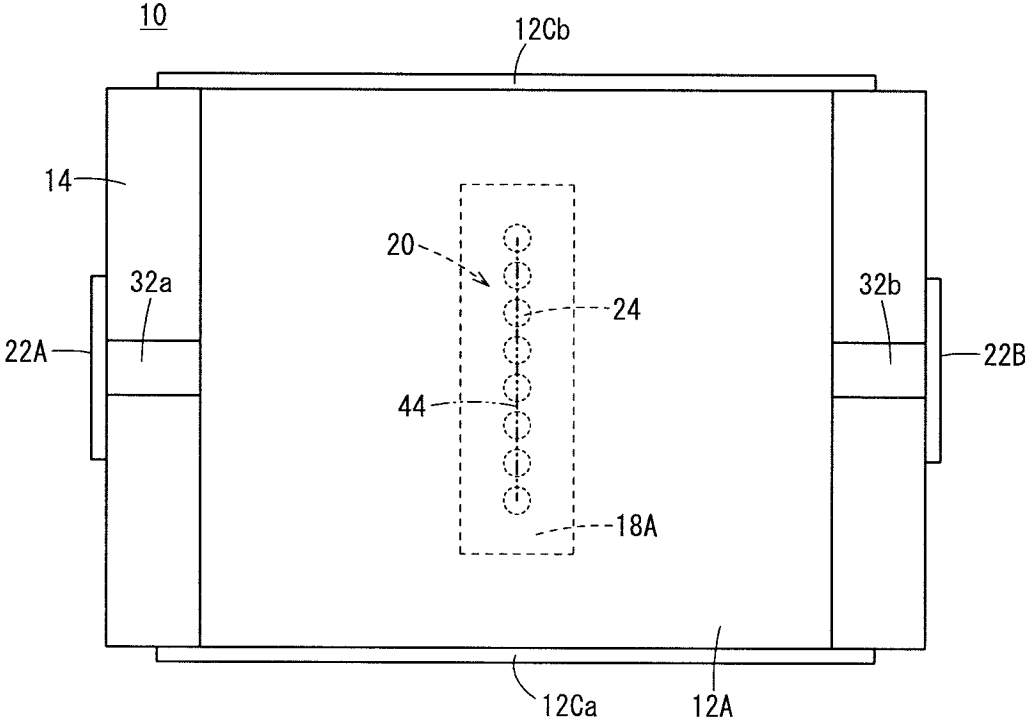
FIG. 10 is a plan view showing a resonator according to modified example 5 of the first embodiment.

A resonator according to modified example 5 of the present embodiment will be described using FIG. 10. FIG. 10 is a plan view showing the resonator according to the present modified example.

In the resonator 10 according to the present modified example, the plurality of via electrodes 24 configuring the via electrode portion 20 are arranged along an imaginary straight line 44. In the present modified example, since the plurality of via electrodes 24 configuring the via electrode portion 20 are arranged so as to lie along the imaginary straight line 44, the via electrode portion 20 may behave like a via electrode of large diameter corresponding to the imaginary straight line 44. In this way, the via electrode portion 20 may be configured by the plurality of via electrodes 24 being arranged so as to lie along the imaginary straight line 44.

Modified Example 6

Figure 11A:
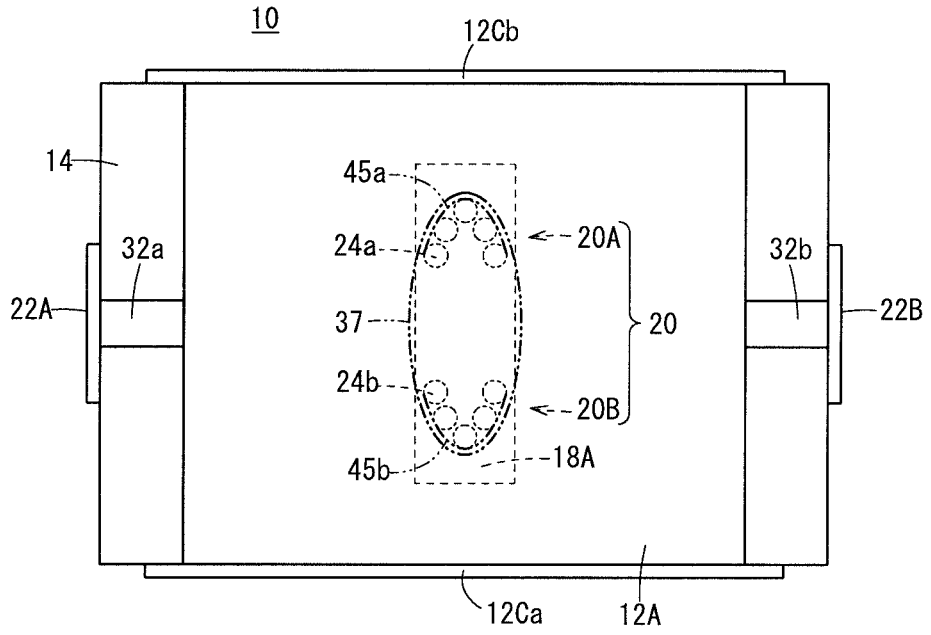
FIGS. 11A and 11B are plan views showing a resonator according to modified example 6 of the first embodiment.
Figure 11B:
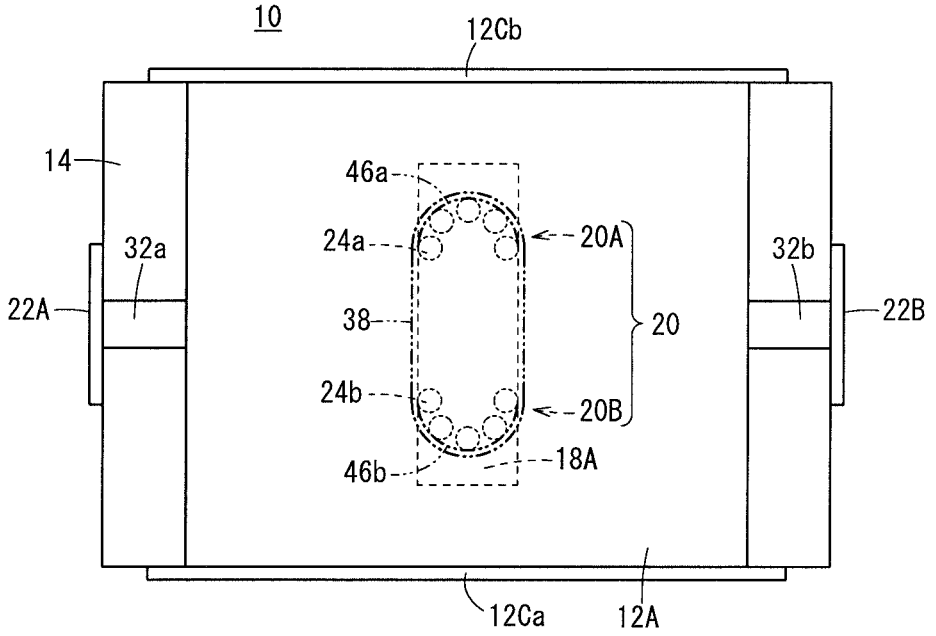

A resonator according to modified example 6 of the present embodiment will be described using FIGS. 11A to 12. FIGS. 11A and 11B are plan views showing the resonator according to the present modified example. FIG. 11A shows an example where a first via electrode 24*a* and a second via electrode 24*b* are arranged so as to lie along parts of the imaginary ellipse 37. FIG. 11B shows an example where the first via electrode 24*a* and the second via electrode 24*b* are arranged to as to lie along parts of the imaginary track shape 38.

In the present modified example, the via electrode portion 20 includes a first via electrode portion 20A and a second via electrode portion 20B. The first via electrode portion 20A and the second via electrode portion 20B are disposed adjacently to each other. The first via electrode portion 20A is configured from a plurality of the first via electrodes 24*a*. The second via electrode portion 20B is configured from a plurality of the second via electrodes 24*b*. No other via electrode portion exists between the first via electrode portion 20A and the second via electrode portion 20B.

In the example shown in FIG. 11A, the plurality of first via electrodes 24*a* are arranged along a first imaginary curved line 45*a* configuring part of a profile line of the imaginary ellipse 37, when viewed from an upper surface. Moreover, in the example shown in FIG. 11A, the plurality of second via electrodes 24*b* are arranged along a second imaginary curved line 45*b* configuring part of the profile line of the imaginary ellipse 37, when viewed from the upper surface. In the example shown in FIG. 11B, the plurality of first via electrodes 24*a* are arranged along a first imaginary curved line 46*a* configuring part of a profile line of the imaginary track shape 38, when viewed from an upper surface. Moreover, in the example shown in FIG. 11B, the plurality of second via electrodes 24*b* are arranged along a second imaginary curved line 46*b* configuring part of the profile line of the imaginary track shape 38, when viewed from the upper surface. Although FIGS. 11A and 11B show examples where the first via electrode portion 20A is configured by five first via electrodes 24*a*, and the second via electrode portion 20B is configured by five second via electrodes 24*b*, the present modified example is not limited to this. The first via electrode portion 20A may be configured by, for example, three first via electrodes 24*a*, and the second via electrode portion 20B may be configured by, for example, three second via electrodes 24*b*. Moreover, the first via electrode portion 20A may be configured by, for example, seven first via electrodes 24*a*, and the second via electrode portion 20B may be configured by, for example, seven second via electrodes 24*b*.

In the present modified example, the first via electrodes 24*a* and the second via electrodes 24*b* are arranged so as to lie along the imaginary ellipse 37 or the imaginary track shape 38. The reason for the arrangement is as follows: in the case of the resonators 10 being multi-staged to configure a filter, if a diameter of the via electrode portion 20 is simply made larger, then an electric wall occurs between the resonators 10, leading to a deterioration in the Q-factor. In contrast, if the via electrode portion 20 is configured in an elliptical shape, and the resonators 10 are multi-staged in a short axis direction of the elliptical shape, then a distance between the via electrode portions 20 becomes longer, hence the Q-factor can be improved. Moreover, if the via electrode portion 20 is configured in the imaginary track shape 38, and the resonators 10 are multi-staged in a direction perpendicular to a longitudinal direction of the straight-line portions of the imaginary track shape 38, then a distance between the via electrode portions 20 becomes longer, hence the Q-factor can be improved. For such reasons, in the present modified example, the first via electrodes 24*a* and the second via electrodes 24*b* are arranged so as to lie along the imaginary ellipse 37 or the imaginary track shape 38.

Moreover, in the present modified example, the first via electrodes 24*a* and the second via electrodes 24*b* are respectively disposed in end portions of the imaginary ellipse 37, that is, both end portions where curvature is large, of the imaginary ellipse 37. Moreover, in the present modified example, the first via electrodes 24*a* and the second via electrodes 24*b* are respectively disposed in the semicircular portions of the imaginary track shape 38. The reason for the arrangement is as follows: a high frequency current concentrates in the end portions of the imaginary ellipse 37, that is, both end portions where curvature is large, of the imaginary ellipse 37. Moreover, a high frequency current concentrates in both end portions of the imaginary track shape 38, that is, the semicircular portions of the imaginary track shape 38. Therefore, even if the via electrodes 24*a*, 24*b* are configured not to be disposed in a portion other than both end portions of the imaginary ellipse 37 or the imaginary track shape 38, it never leads to a significant lowering of the high frequency current. In addition, if the number of via electrodes 24*a*, 24*b* is reduced, a time required for forming the vias can be shortened, hence an improvement in throughput can be achieved. Moreover, if the number of via electrodes 24*a*, 24*b* is reduced, a material such as silver embedded in the vias may be reduced, hence a reduction in costs can also be achieved. Moreover, since a region where an electromagnetic field is comparatively sparse is formed between the first via electrode portion 20A and the second via electrode portion 20B, it is also possible for a pattern for coupling adjustment, and so on, to be formed in the region. From such viewpoints, in the present modified example, the first via electrodes 24*a* and the second via electrodes 24*b* are disposed in both end portions of the imaginary ellipse 37 or the imaginary track shape 38.

Figure 12:
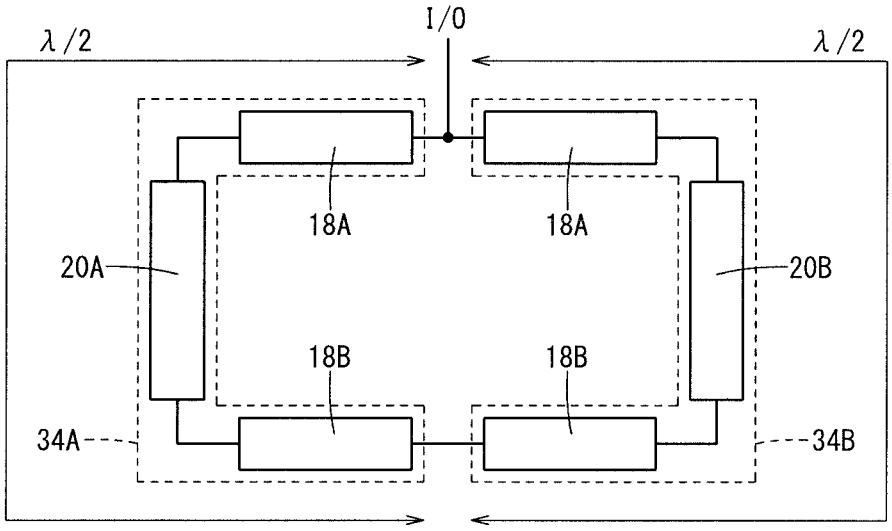
FIG. 12 is a view showing an equivalent circuit of the resonator according to modified example 6 of the first embodiment.

FIG. 12 is a view showing an equivalent circuit of the resonator according to the present modified example. As shown in FIG. 12, there is configured a first $\lambda/2$ resonator 34A that includes: part of the lower strip line 18B; the first via electrode portion 20A; and part of the upper strip line 18A. Moreover, as shown in FIG. 12, there is configured a second $\lambda/2$ resonator 34B that includes: another part of the lower strip line 18B; the second via electrode portion 20B; and another part of the upper strip line 18A. A current of the same phase flows in the first $\lambda/2$ resonator 34A and the second $\lambda/2$ resonator 34B. Since the current flowing in the first $\lambda/2$ resonator 34A and in the second $\lambda/2$ resonator 34B has the same phase, a region between the first via electrode portion 20A and the second via electrode portion 20B is in a state of the electromagnetic field being sparse. Therefore, in the present modified example, it becomes possible for a pattern to be disposed between the first via electrode portion 20A and the second via electrode portion 20B, while unnecessary coupling is suppressed.

In this way, the via electrode portion 20 may be configured by the first via electrode portion 20A and the second via electrode portion 20B that are adjacent to each other. In addition, the first via electrode portion 20A and the second via electrode portion 20B may be arranged so as to respectively lie along the first imaginary curved line 45*a* and the second imaginary curved line 45*b* that configure parts of the profile line of the imaginary ellipse 37. Moreover, the first via electrode portion 20A and the second via electrode portion 20B may be arranged so as to respectively lie along the first imaginary curved line 46*a* and the second imaginary curved line 46*b* that configure parts of the profile line of the imaginary track shape 38.

Modified Example 7

Figure 13:
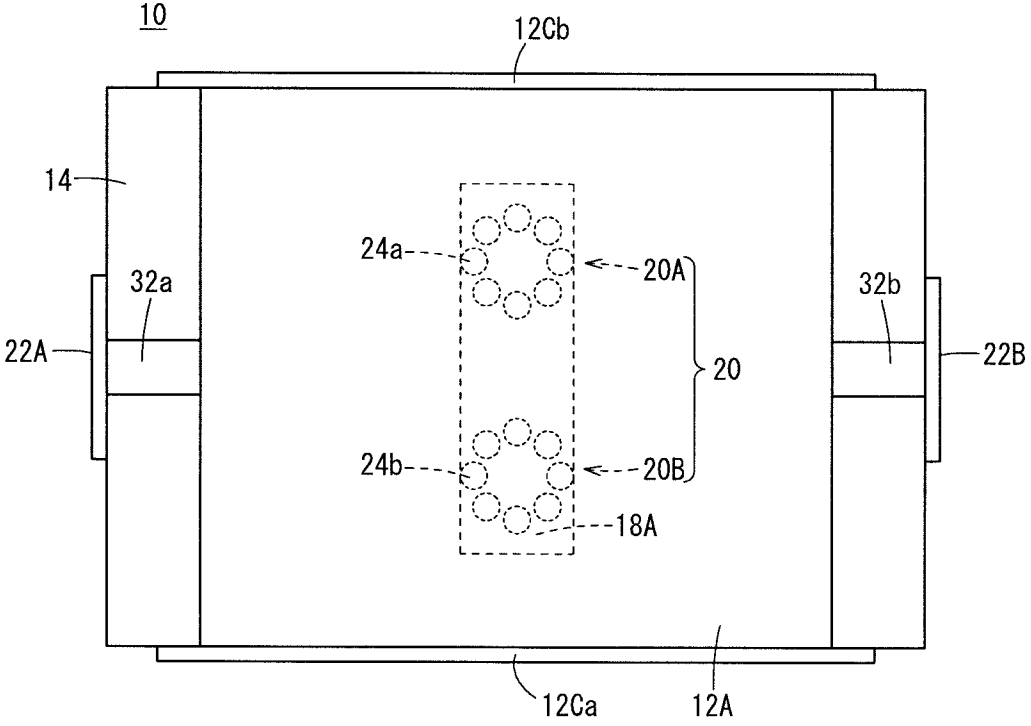
FIG. 13 is a plan view showing a resonator according to modified example 7 of the first embodiment.

A resonator according to modified example 7 of the present embodiment will be described using FIG. 13. FIG. 13 is a plan view showing the resonator according to the present modified example.

A resonator 10 according to the present modified example has its first via electrode portion 20A and its second via electrode portion 20B each arranged so as to lie along an imaginary circle.

An evaluation result of the resonator 10 according to the present modified example will be described below. A resonator according to a reference example was configured by directly connecting to the upper shielding conductor 12A an upper end of the first via electrode portion 20A and an upper end of the second via electrode portion 20B. An unloaded Q-factor of the resonator according to the reference example was found, upon measurement, to be approximately 450. An unloaded Q-factor of the resonator 10 according to the embodiment, that is, the present modified example was found, upon measurement, to be approximately 540. It may be understood from this that the present modified example enables the unloaded Q-factor to be improved by approximately 20% compared to the reference example.

In this way, the first via electrode portion 20A and the second via electrode portion 20B may be arranged so as to each lie along an imaginary circle.

Modified Example 8

Figure 14:
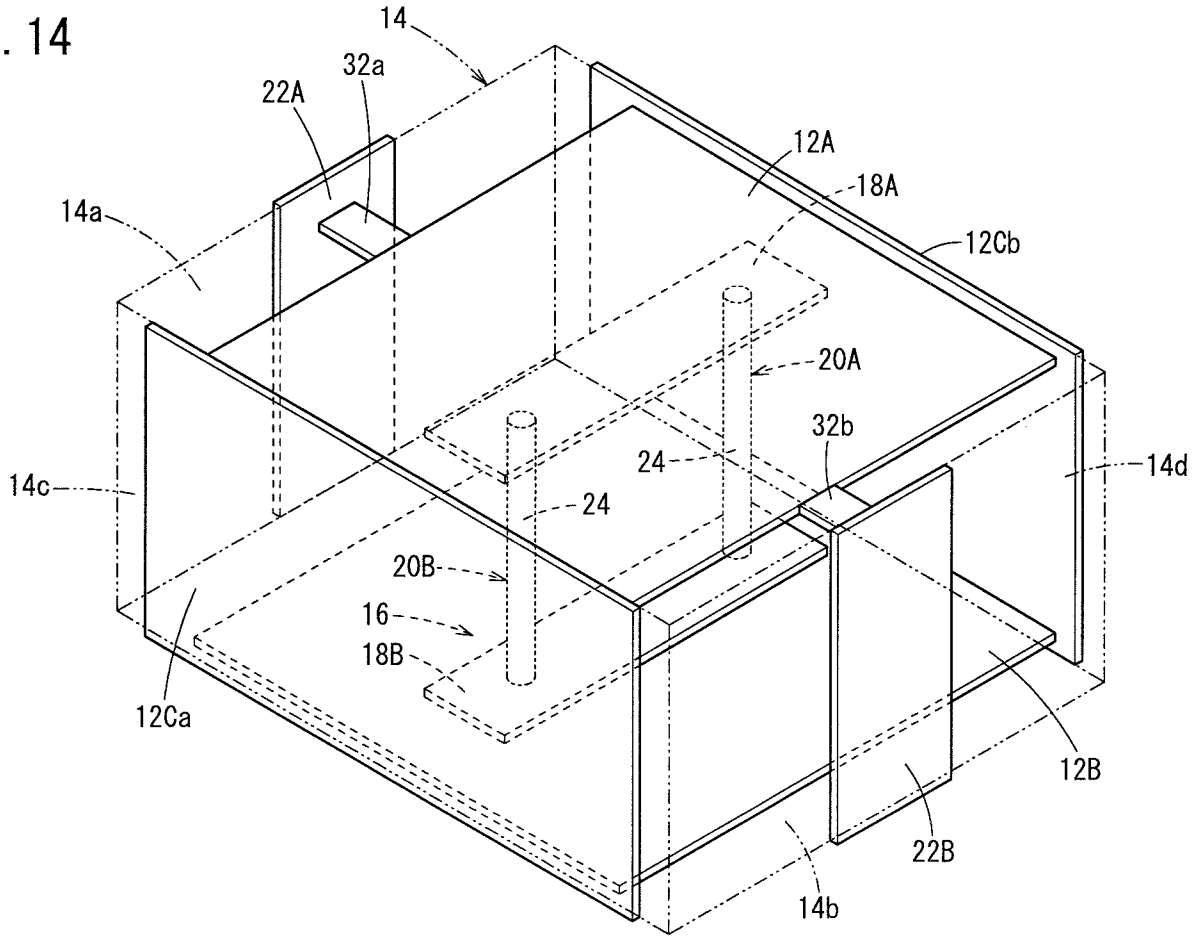
FIG. 14 is a perspective view showing a resonator according to modified example 8 of the first embodiment.

A resonator according to modified example 8 of the present embodiment will be described using FIG. 14. FIG. 14 is a perspective view showing the resonator according to the present modified example.

A resonator 10 according to the present modified example has its first via electrode portion 20A and its second via electrode portion 20B each configured by a single via electrode 24. In this way, the first via electrode portion 20A and the second via electrode portion 20B may each be configured by a single via electrode 24.

Modified Example 9

Figure 15:
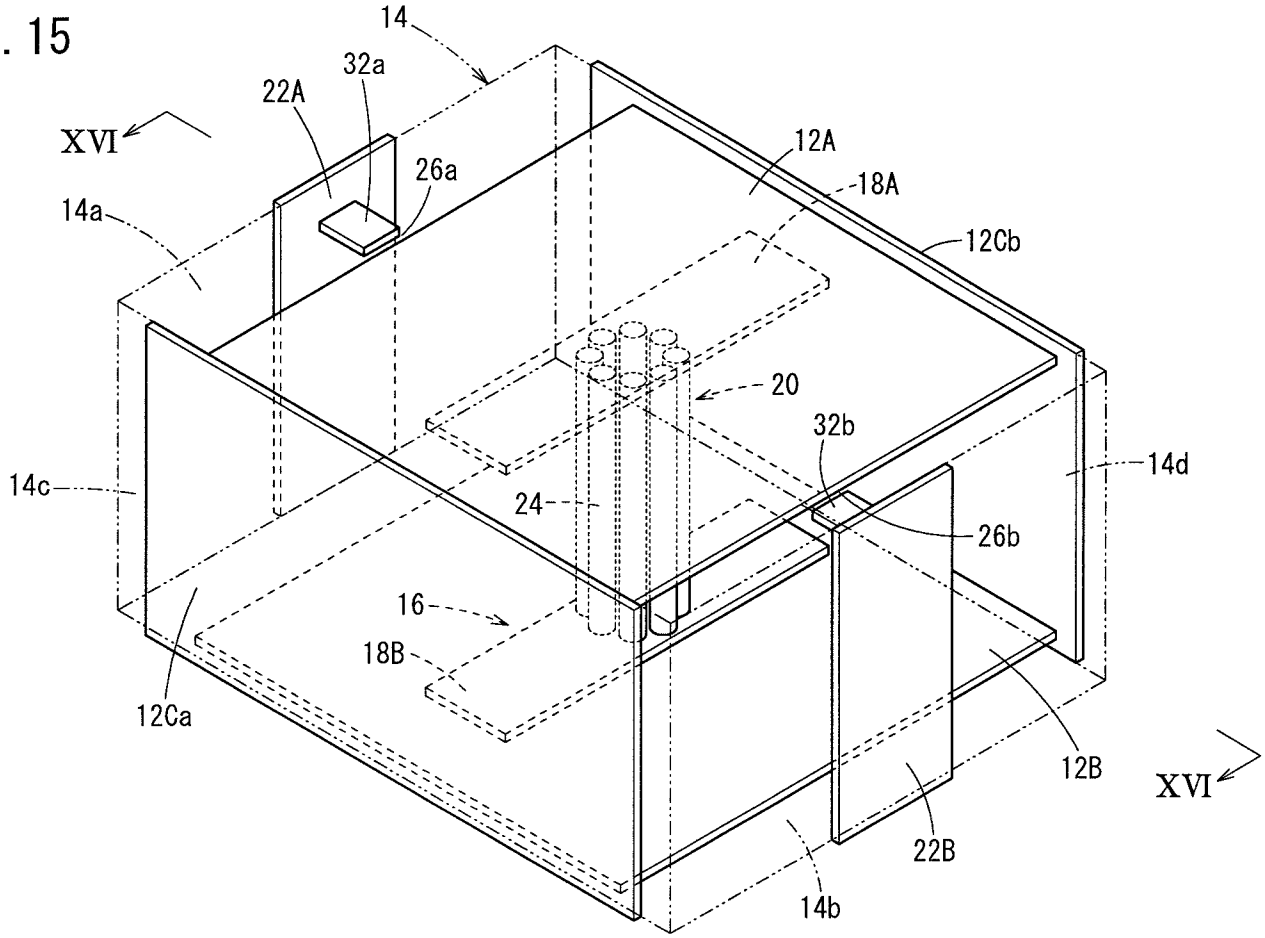
FIG. 15 is a perspective view showing a resonator according to modified example 9 of the first embodiment.
Figure 16:
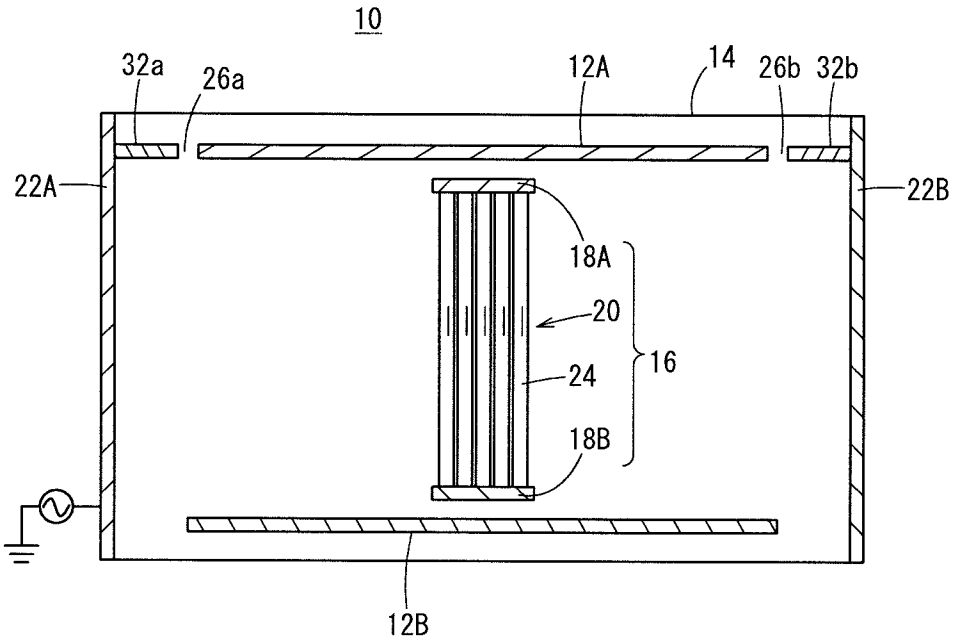
FIG. 16 is a cross-sectional view showing the resonator according to modified example 9 of the first embodiment.
Figure 17:
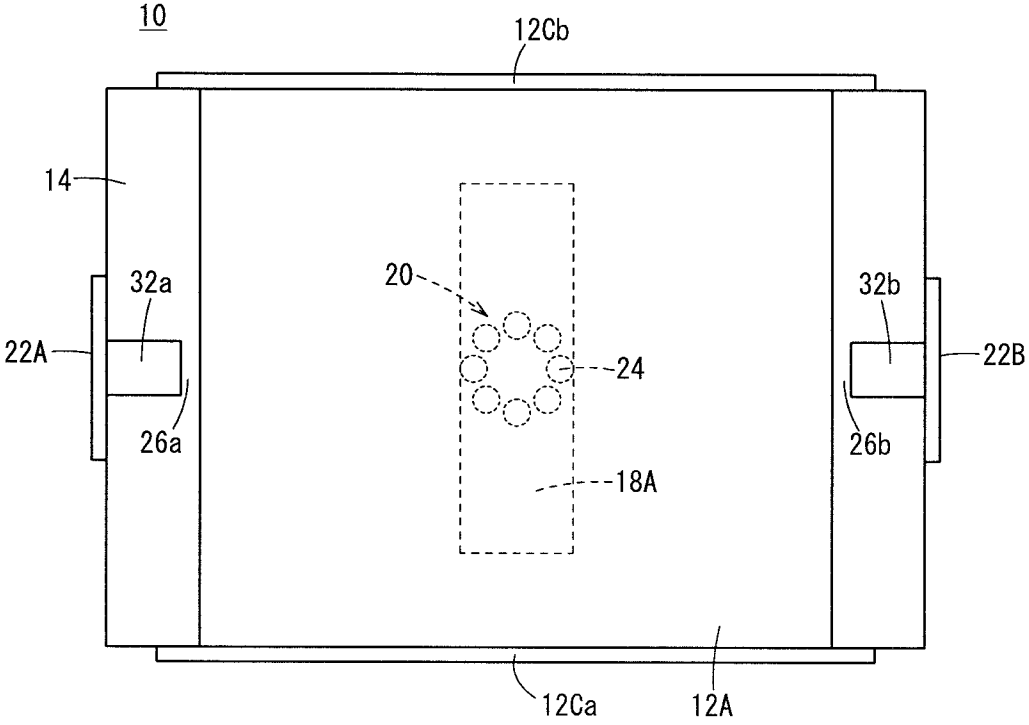
FIG. 17 is a plan view showing the resonator according to modified example 9 of the first embodiment.

A resonator according to modified example 9 of the present embodiment will be described using FIGS. 15 to 17. FIG. 15 is a perspective view showing the resonator according to the present modified example. FIG. 16 is a cross-sectional view showing the resonator according to the present modified example. FIG. 16 corresponds to the line XVI-XVI in FIG. 15. FIG. 17 is a plan view showing the resonator according to the present modified example.

In a resonator 10 according to the present modified example, the first input/output terminal 22A and the second input/output terminal 22B are not electrically continuous with the upper shielding conductor 12A. In the present modified example, the first connection line 32*a* connected to the first input/output terminal 22A, and the upper shielding conductor 12A are capacitively coupled via a first gap 26*a*. Moreover, in the present modified example, the second connection line 32*b* connected to the second input/output terminal 22B, and the upper shielding conductor 12A are capacitively coupled via a second gap 26*b*.

In this way, the first input/output terminal 22A and the second input/output terminal 22B need not be electrically continuous with the upper shielding conductor 12A. Due to the present modified example, a capacitance is formed between the first connection line 32*a* connected to the first input/output terminal 22A, and the upper shielding conductor 12A. Moreover, due to the present modified example, a capacitance is formed between the second connection line 32*b* connected to the second input/output terminal 22B, and the upper shielding conductor 12A. Therefore, the present modified example enables external Q to be adjusted by appropriately setting these capacitances.

Note that although there has been described here as an example the case where the resonator 10 shown in FIGS. 4 to 6 has been configured such that the first input/output terminal 22A and the second input/output terminal 22B are not made electrically continuous with the upper shielding conductor 12A, the present modified example is not limited to this. The resonators 10 shown in FIGS. 1 to 3, and FIGS. 7A to 14 may be configured such that the first input/output terminal 22A and the second input/output terminal 22B are not made electrically continuous with the upper shielding conductor 12A. That is, in the resonator 10 shown in FIGS. 1 to 3, a configuration may be adopted whereby the first connection line 32*a* connected to the first input/output terminal 22A, and the upper shielding conductor 12A are capacitively coupled via the first gap 26*a*. Moreover, in the resonator 10 shown in FIGS. 1 to 3, a configuration may be adopted whereby the second connection line 32*b* connected to the second input/output terminal 22B, and the upper shielding conductor 12A are capacitively coupled via the second gap 26*b*. In addition, in the resonators 10 shown in FIGS. 7A to 14, a configuration may be adopted whereby the first connection line 32*a* connected to the first input/output terminal 22A, and the upper shielding conductor 12A are capacitively coupled via the first gap 26*a*. Moreover, in the resonators 10 shown in FIGS. 7A to 14, a configuration may be adopted whereby the second connection line 32*b* connected to the second input/output terminal 22B, and the upper shielding conductor 12A are capacitively coupled via the second gap 26*b*.

Modified Example 10

Figure 18:
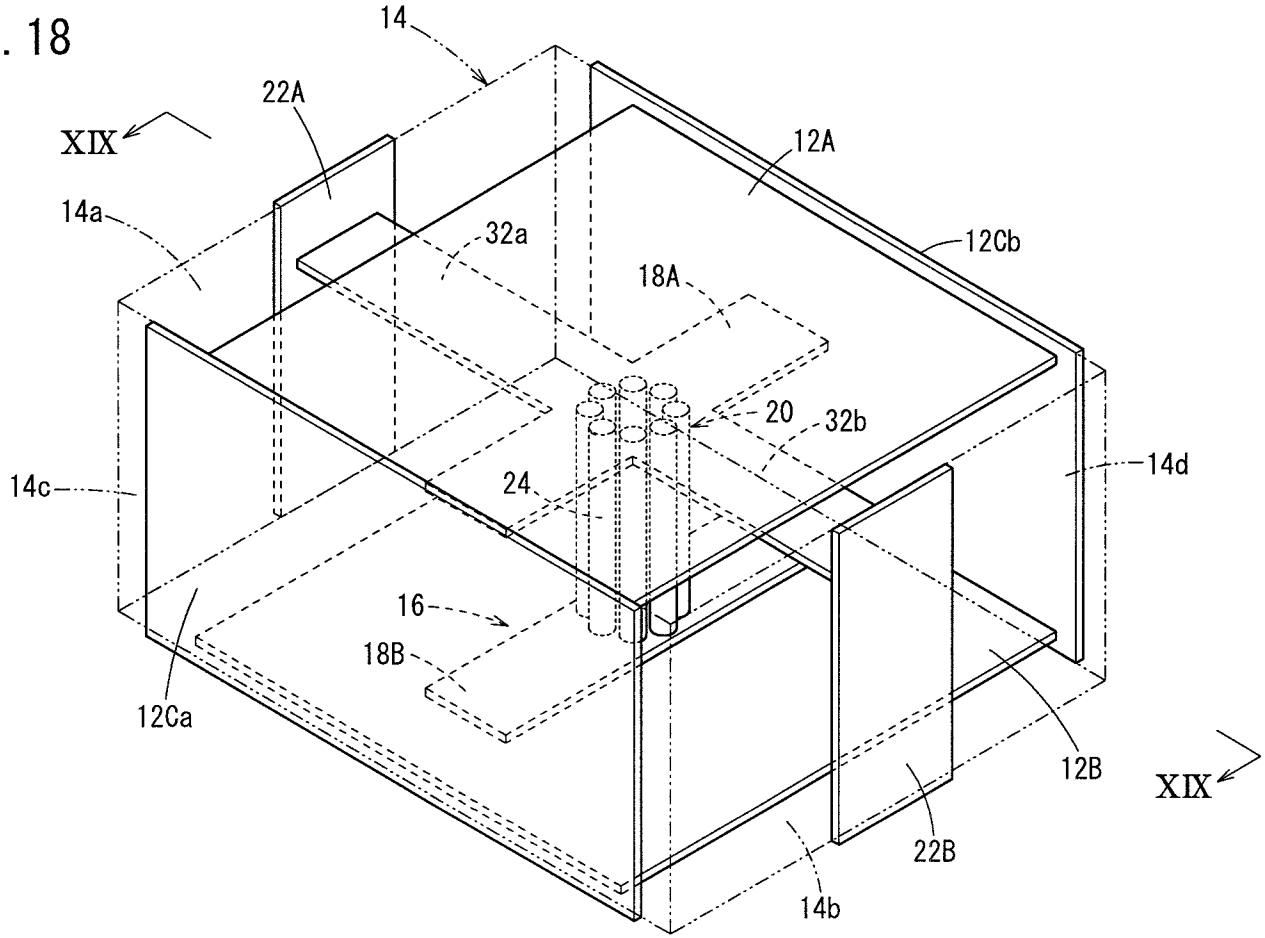
FIG. 18 is a perspective view showing a resonator according to modified example 10 of the first embodiment.
Figure 19:
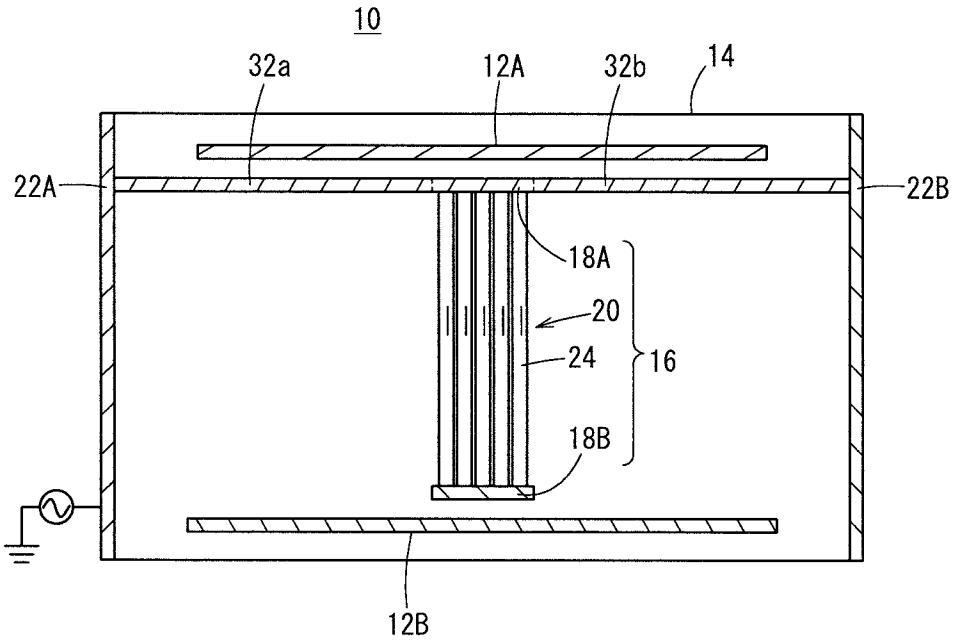
FIG. 19 is a cross-sectional view showing the resonator according to modified example 10 of the first embodiment.
Figure 20:
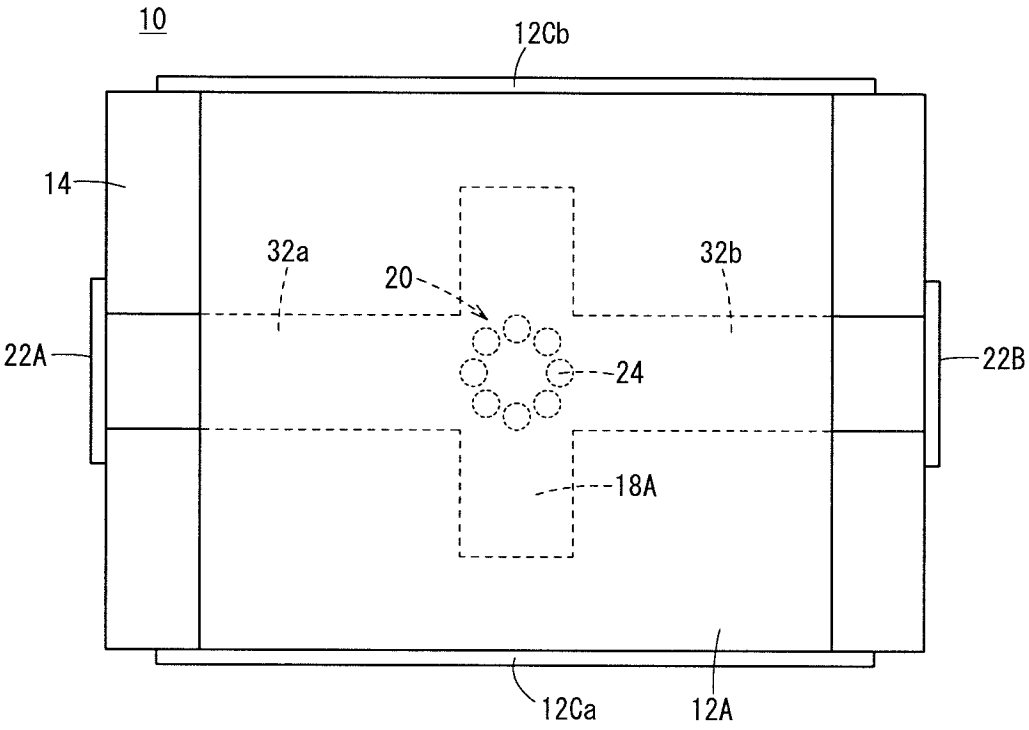
FIG. 20 is a plan view showing the resonator according to modified example 10 of the first embodiment.

A resonator according to modified example 10 of the present embodiment will be described using FIGS. 18 to 20. FIG. 18 is a perspective view showing the resonator according to the present modified example. FIG. 19 is a cross-sectional view showing the resonator according to the present modified example. FIG. 19 corresponds to the line XIX-XIX in FIG. 18. FIG. 20 is a plan view showing the resonator according to the present modified example.

In a resonator 10 according to the present modified example, the first input/output terminal 22A and the second input/output terminal 22B are electrically continuous with the upper strip line 18A. In the present modified example, the first input/output terminal 22A and the second input/output terminal 22B are not connected to the upper shielding conductor 12A. In the present modified example too, a $\lambda/2$ resonator with a good Q-factor may be achieved.

Note that although there has been described here as an example the case where the resonator 10 shown in FIG. 4 has its first input/output terminal 22A and its second input/output terminal 22B made electrically continuous with its upper strip line 18A, the present modified example is not limited to this. The resonators 10 shown in FIGS. 1 to 3, and FIGS. 7A to 14 may be configured such that their first input/output terminal 22A and their second input/output terminal 22B are made electrically continuous with their upper strip line 18A.

Modified Example 11

Figure 22:
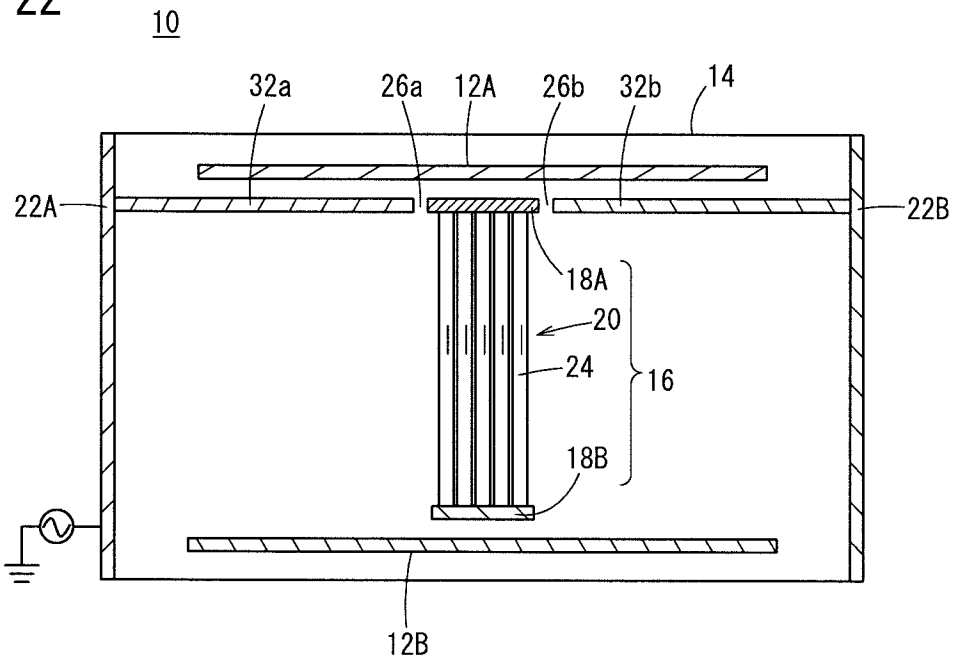
FIG. 22 is a cross-sectional view showing the resonator according to modified example 11 of the first embodiment.
Figure 23:
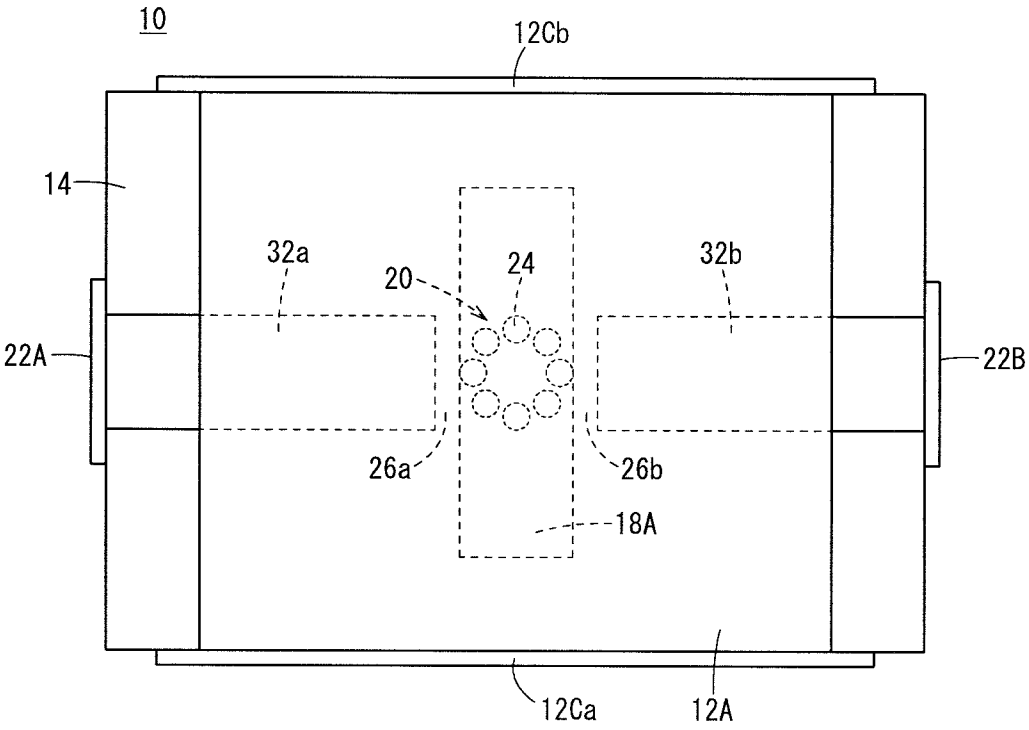
FIG. 23 is a plan view showing the resonator according to modified example 11 of the first embodiment.

A resonator according to modified example 11 of the present embodiment will be described using FIGS. 21 to 23.

Figure 21:
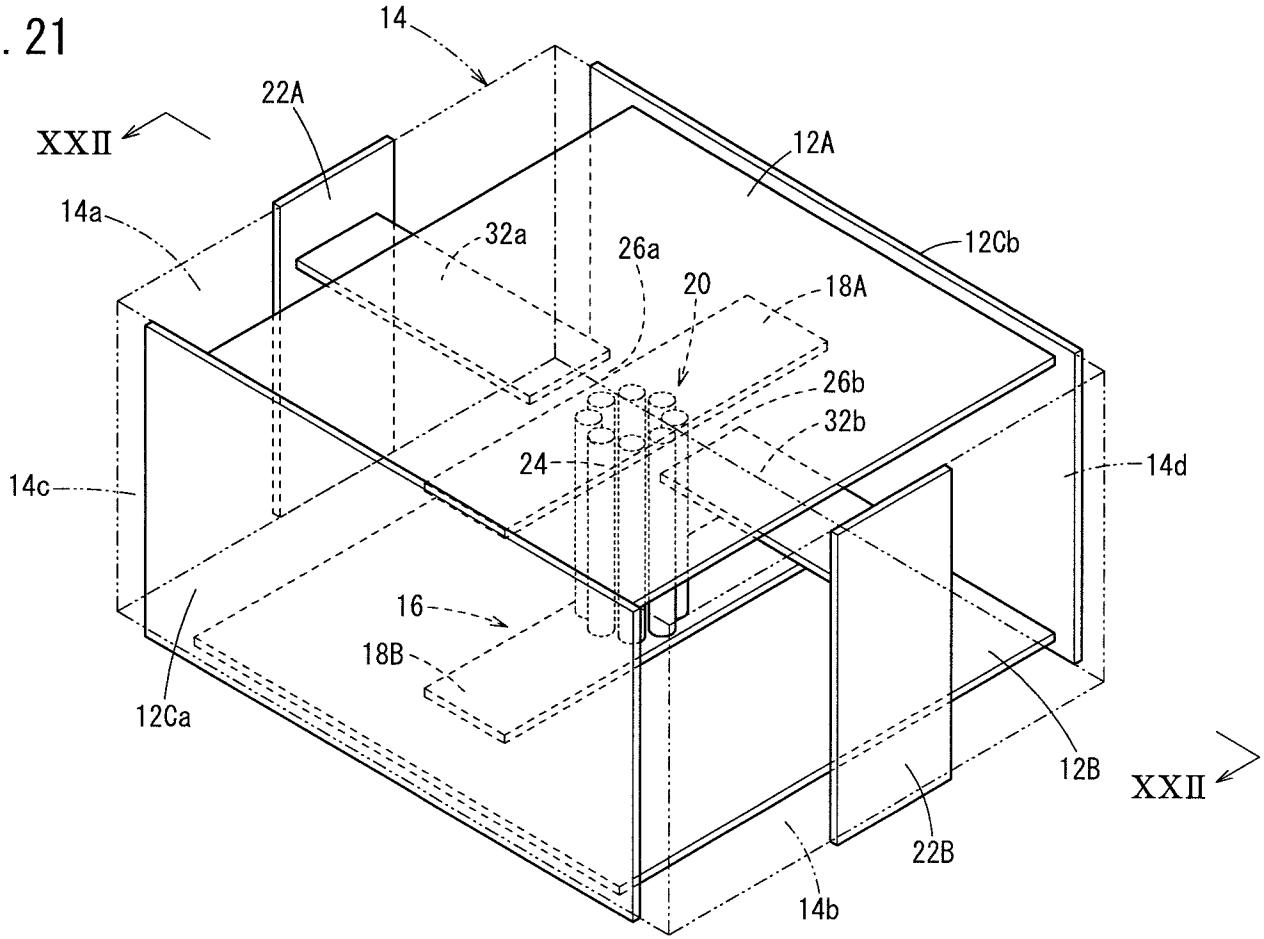
FIG. 21 is a perspective view showing a resonator according to modified example 11 of the first embodiment.

FIG. 21 is a perspective view showing the resonator according to the present modified example. FIG. 22 is a cross-sectional view showing the resonator according to the present modified example. FIG. 22 corresponds to the line XXII-XXII in FIG. 21. FIG. 23 is a plan view showing the resonator according to the present modified example.

In a resonator 10 according to the present modified example, the first input/output terminal 22A and the second input/output terminal 22B are not electrically continuous with the upper strip line 18A. In the present modified example, the first connection line 32*a* connected to the first input/output terminal 22A, and the upper strip line 18A are capacitively coupled via the first gap 26*a*. Moreover, in the present modified example, the second connection line 32*b* connected to the second input/output terminal 22B, and the upper strip line 18A are capacitively coupled via the second gap 26*b*.

In this way, the first input/output terminal 22A and the second input/output terminal 22B need not be electrically continuous with the upper strip line 18A. Due to the present modified example, a capacitance is formed between the first connection line 32*a* connected to the first input/output terminal 22A, and the upper strip line 18A. Moreover, due to the present modified example, a capacitance is formed between the second connection line 32*b* connected to the second input/output terminal 22B, and the upper strip line 18A. Therefore, the present modified example enables external Q to be adjusted by appropriately setting these capacitances.

Note that there has been described here as an example the case where the resonator 10 shown in FIG. 4 has its first input/output terminal 22A and its second input/output terminal 22B capacitively coupled to its upper strip line 18A via, respectively, the first gap 26*a* and the second gap 26*b*. However, the present modified example is not limited to this. The resonators 10 shown in FIGS. 1 to 3, and FIGS. 7A to 14 may be configured such that their first input/output terminal 22A and their second input/output terminal 22B are capacitively coupled to their upper strip line 18A via, respectively, the first gap 26*a* and the second gap 26*b*.

Modified Example 12

Figure 24:
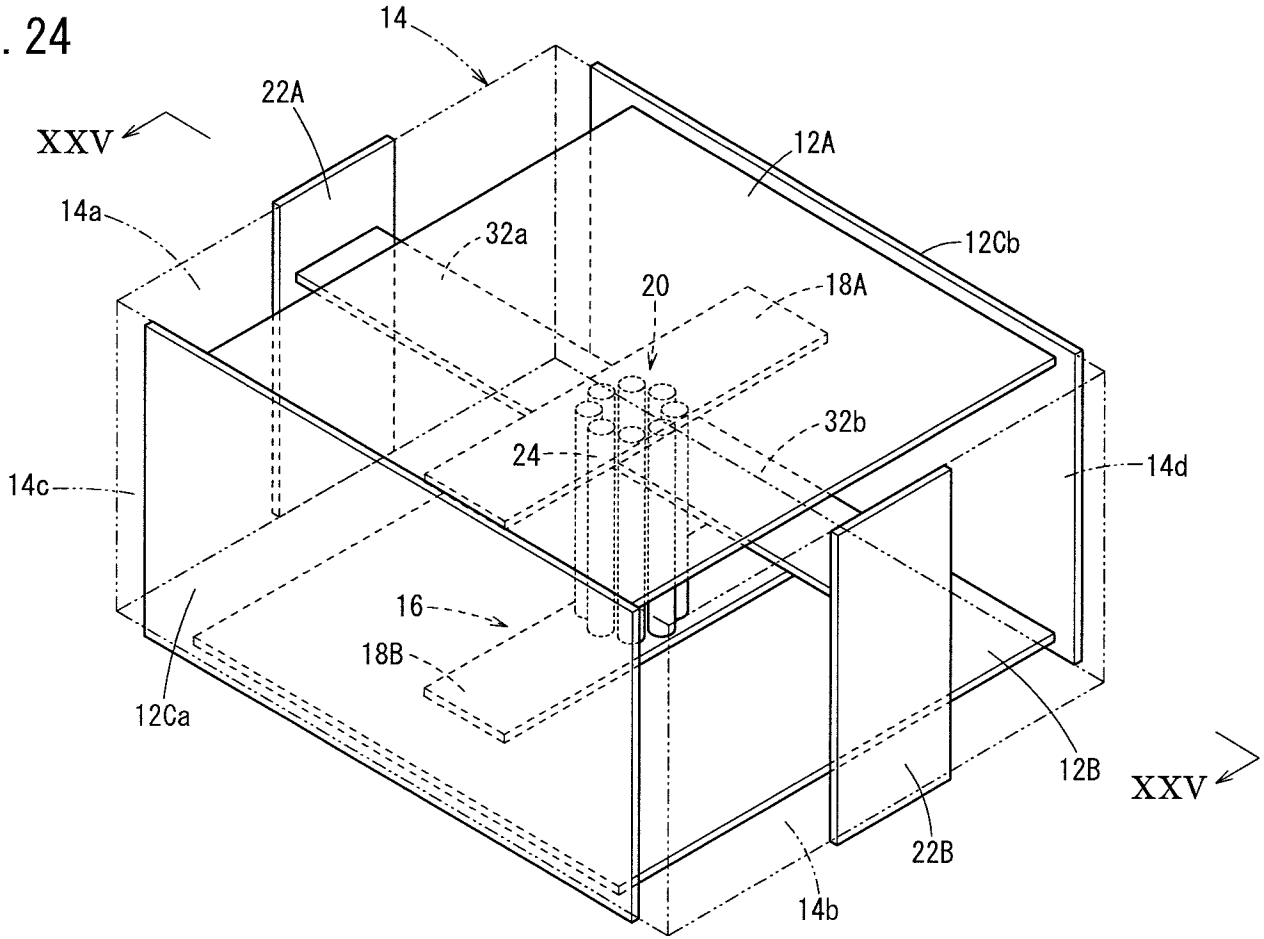
FIG. 24 is a perspective view showing a resonator according to modified example 12 of the first embodiment.
Figure 25:
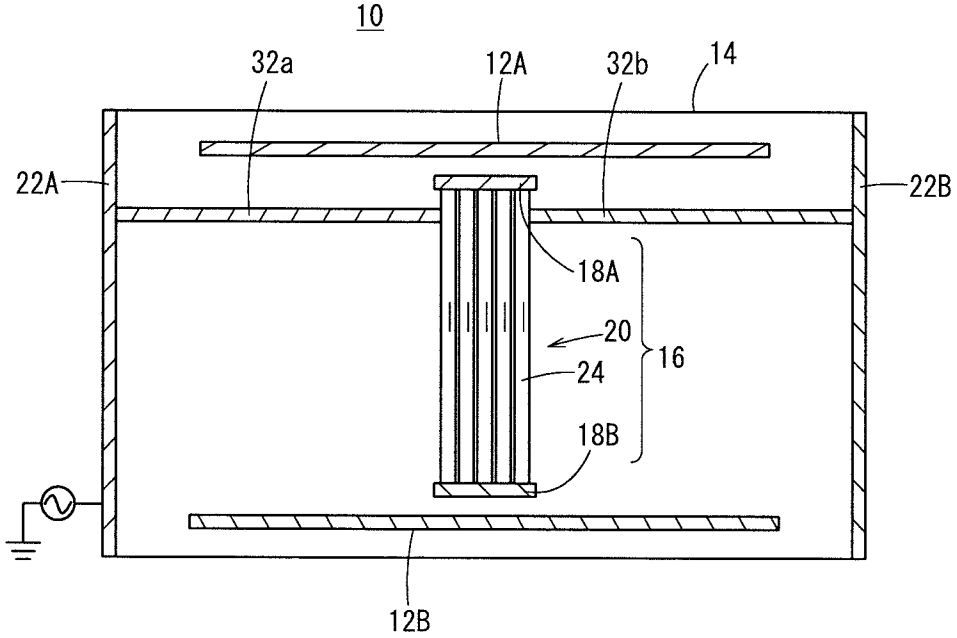
FIG. 25 is a cross-sectional view showing the resonator according to modified example 12 of the first embodiment.
Figure 26:
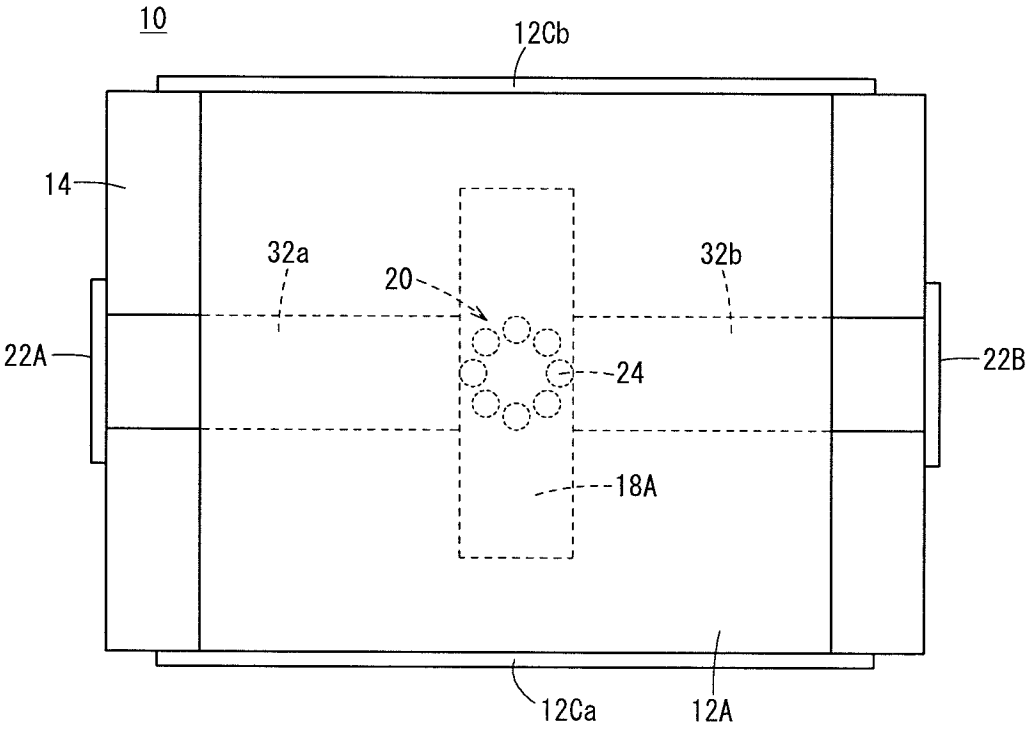
FIG. 26 is a plan view showing the resonator according to modified example 12 of the first embodiment.

A resonator according to modified example 12 of the present embodiment will be described using FIGS. 24 to 26. FIG. 24 is a perspective view showing the resonator according to the present modified example. FIG. 25 is a cross-sectional view showing the resonator according to the present modified example. FIG. 25 corresponds to the line XXV-XXV in FIG. 24. FIG. 26 is a plan view showing the resonator according to the present modified example.

In a resonator 10 according to the present modified example, the first input/output terminal 22A and the second input/output terminal 22B are electrically continuous with the via electrode portion 20. In the present modified example too, a $\lambda/2$ resonator with a good Q-factor may be achieved.

Note that although there has been described here as an example the case where the resonator 10 shown in FIG. 4 has its first input/output terminal 22A and its second input/output terminal 22B made electrically continuous with its via electrode portion 20, the present modified example is not limited to this. The resonators 10 shown in FIGS. 1 to 3, and FIGS. 7A to 14 may be configured such that their first input/output terminal 22A and their second input/output terminal 22B are made electrically continuous with their via electrode portion 20.

Modified Example 13

Figure 27:
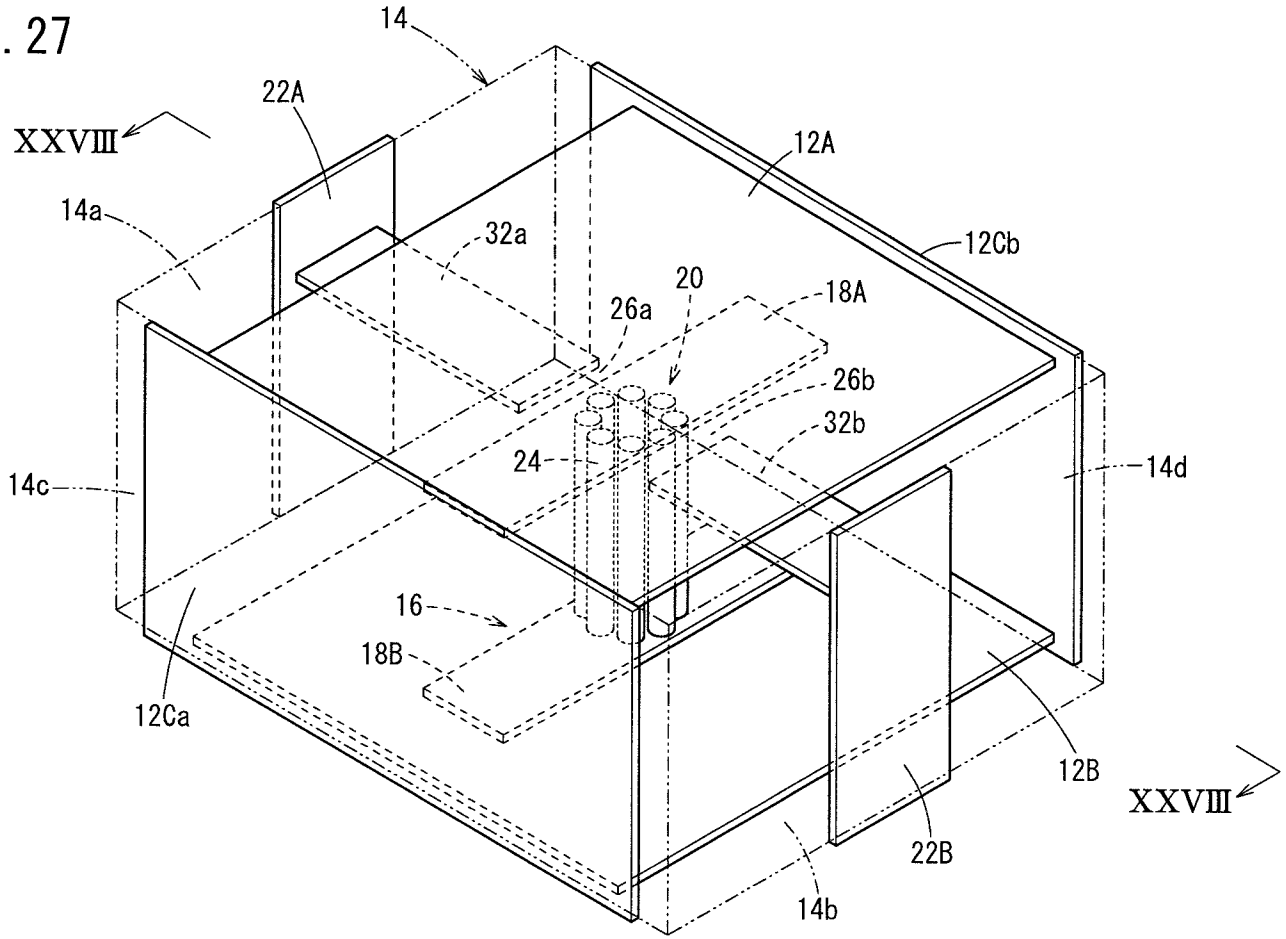
FIG. 27 is a perspective view showing a resonator according to modified example 13 of the first embodiment.
Figure 28:
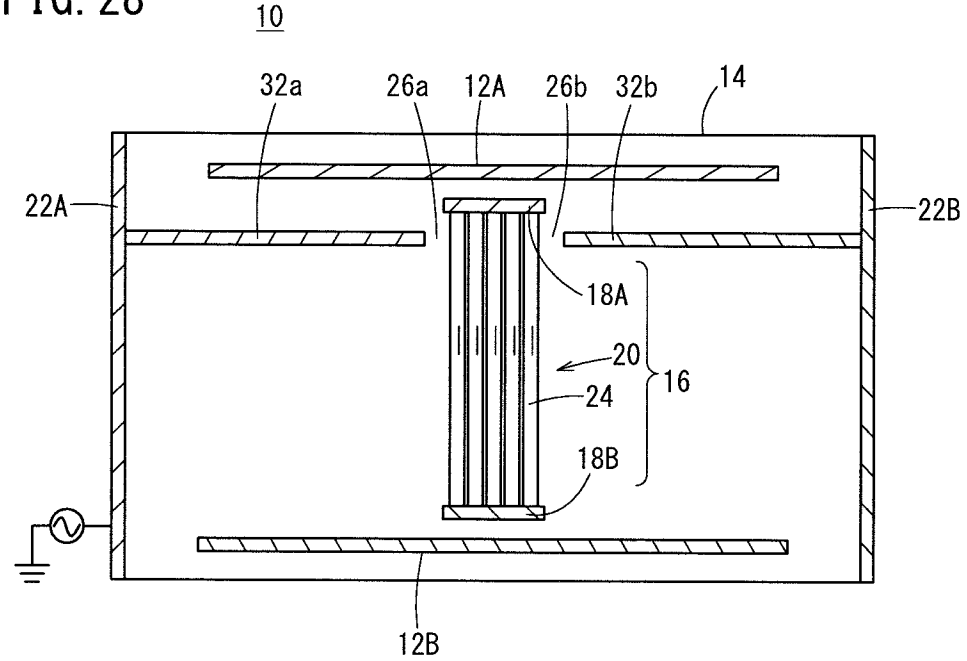
FIG. 28 is a cross-sectional view showing the resonator according to modified example 13 of the first embodiment.
Figure 29:
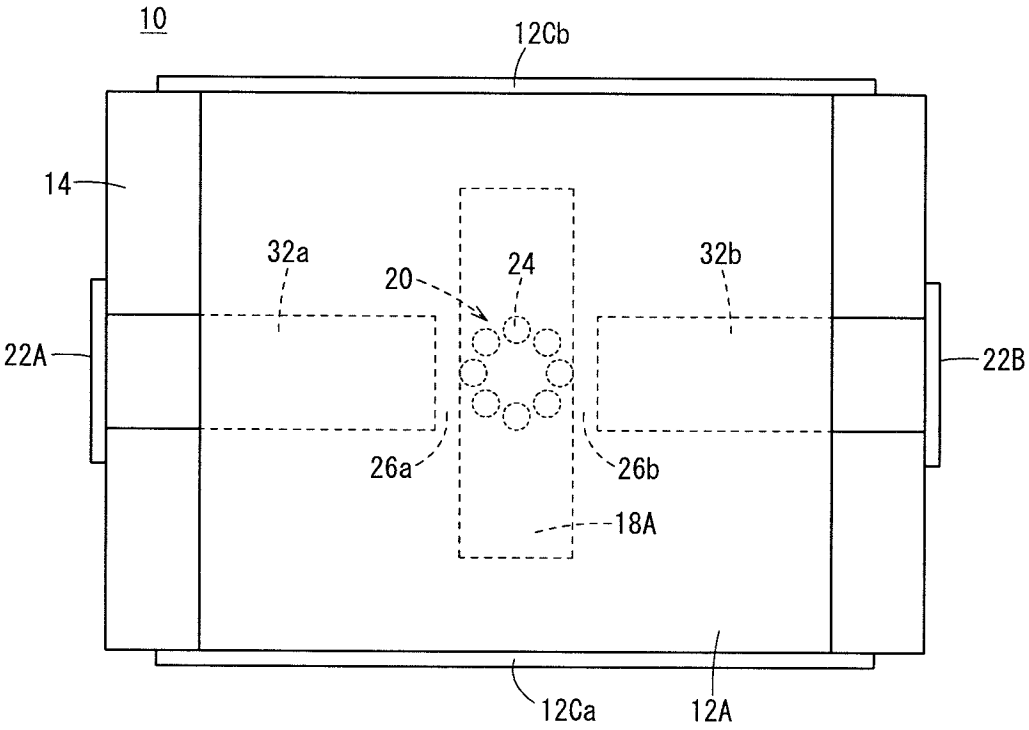
FIG. 29 is a plan view showing the resonator according to modified example 13 of the first embodiment.

A resonator according to modified example 13 of the present embodiment will be described using FIGS. 27 to 29. FIG. 27 is a perspective view showing the resonator according to the present modified example. FIG. 28 is a cross-sectional view showing the resonator according to the present modified example. FIG. 28 corresponds to the line XXVIII-XXVIII in FIG. 27. FIG. 29 is a plan view showing the resonator according to the present modified example.

In a resonator 10 according to the present modified example, the first input/output terminal 22A and the second input/output terminal 22B are not electrically continuous with the via electrode portion 20. In the present modified example, the via electrode portion 20 and the first input/output terminal 22A are capacitively coupled via the first gap 26*a*. Moreover, in the present modified example, the via electrode portion 20 and the second input/output terminal 22B are capacitively coupled via the second gap 26*b*.

In this way, the first input/output terminal 22A and the second input/output terminal 22B need not be electrically continuous with the via electrode portion 20. Due to the present modified example, a capacitance is formed between the via electrode portion 20 and the first input/output terminal 22A. Moreover, due to the present modified example, a capacitance is formed between the via electrode portion 20 and the second input/output terminal 22B. Therefore, the present modified example enables external Q to be adjusted by appropriately setting these capacitances.

Note that there has been described here as an example the case where the resonator 10 shown in FIG. 4 has its first input/output terminal 22A and its second input/output terminal 22B capacitively coupled to its via electrode portion 20 via, respectively, the first gap 26*a* and the second gap 26*b*. However, the present modified example is not limited to this. The resonators 10 shown in FIGS. 1 to 3, and FIGS. 7A to 14 may be configured such that their first input/output terminal 22A and their second input/output terminal 22B are capacitively coupled to their via electrode portion 20 via, respectively, the first gap 26*a* and the second gap 26*b*.

Second Embodiment

Figure 30:
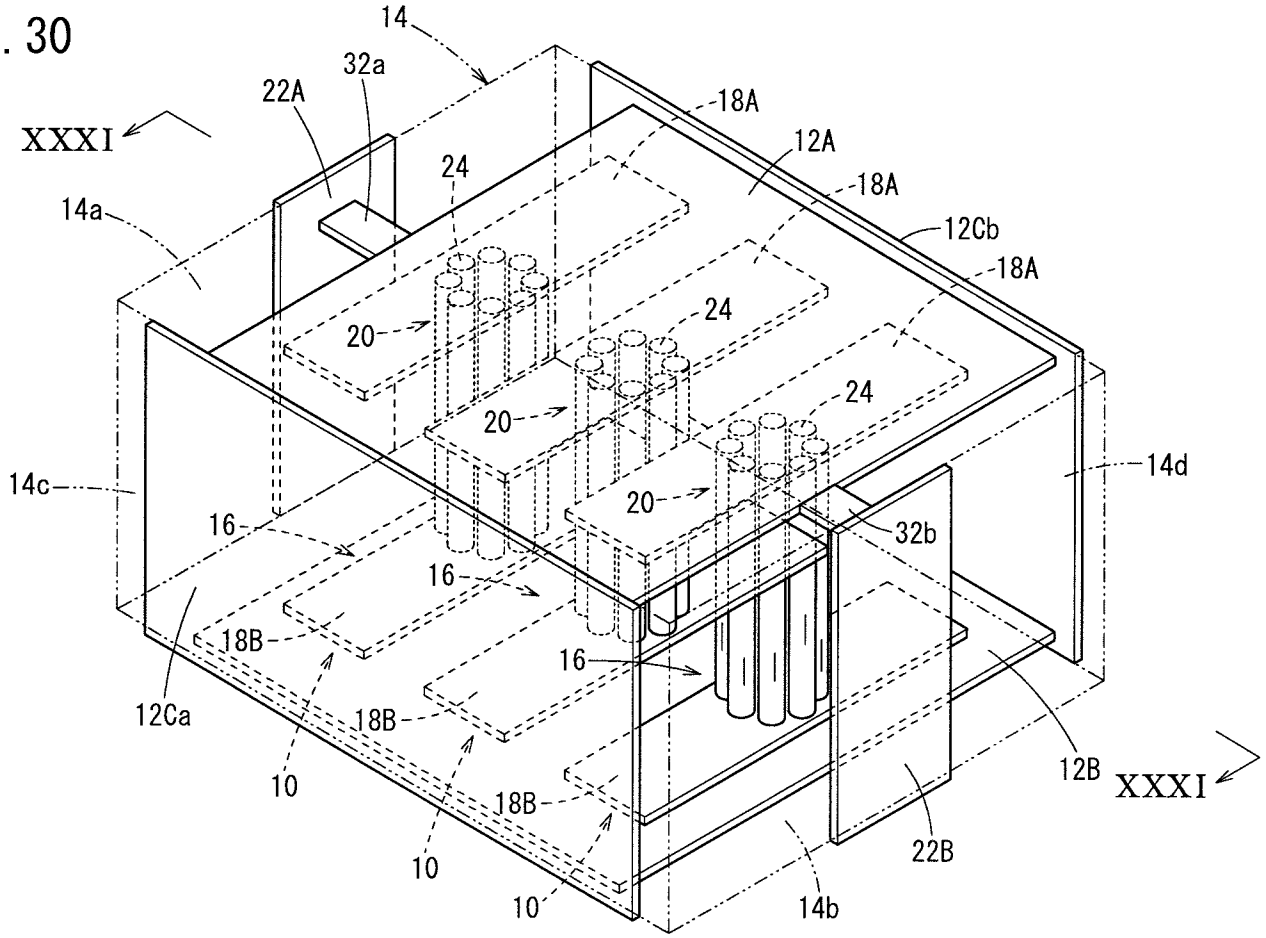
FIG. 30 is a perspective view showing a filter according to a second embodiment.
Figure 31:
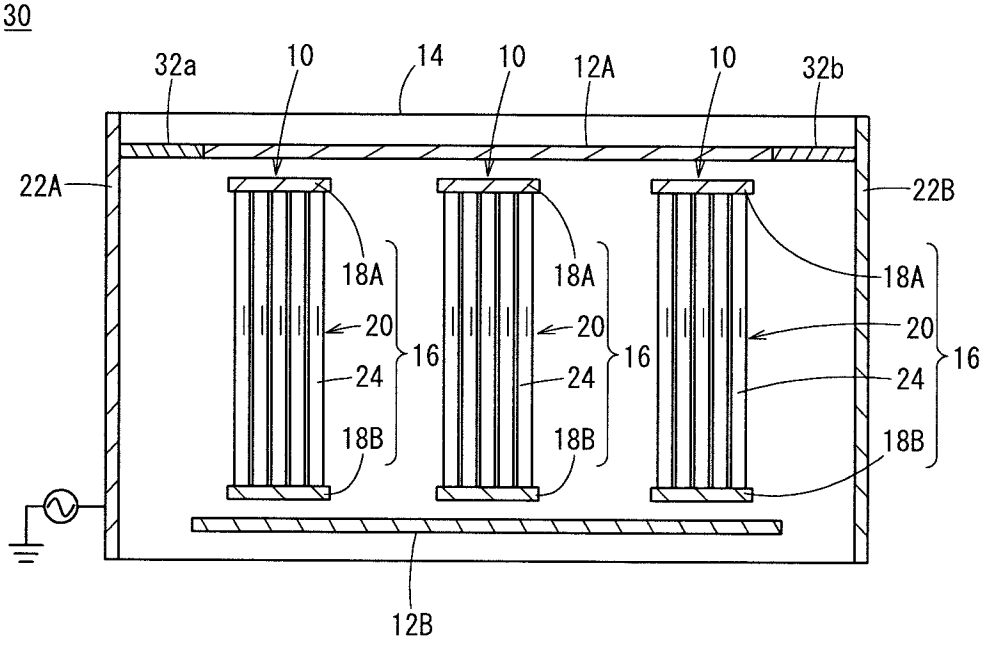
FIG. 31 is a cross-sectional view showing the filter according to the second embodiment.
Figure 32:
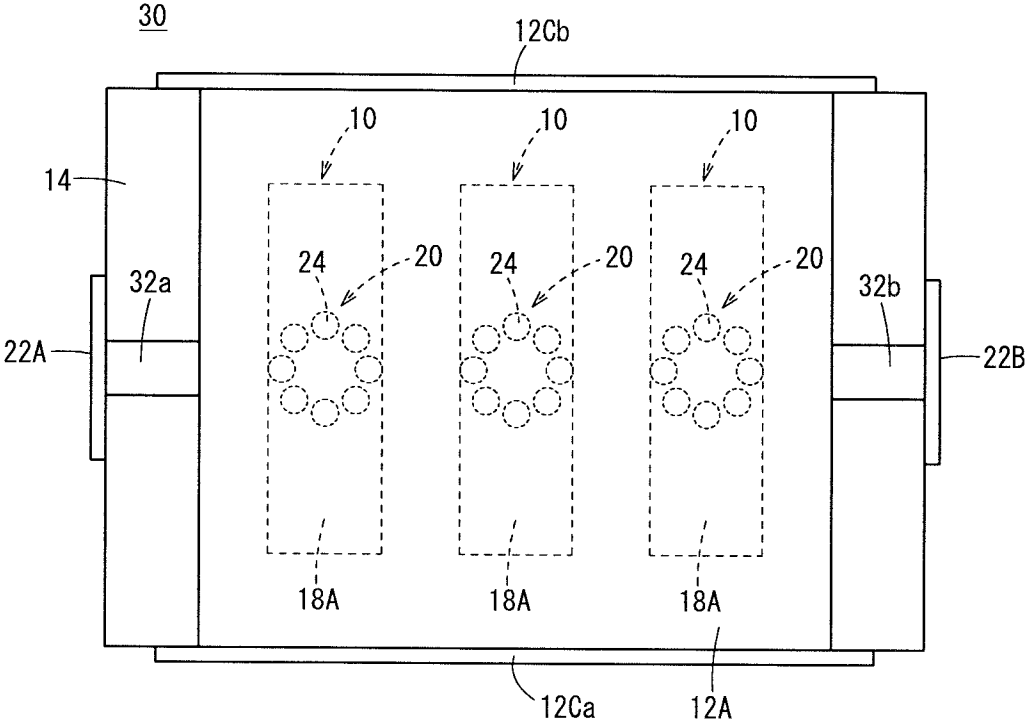
FIG. 32 is a plan view showing the filter according to the second embodiment.

A filter according to a second embodiment will be described using FIGS. 30 to 32. FIG. 30 is a perspective view showing the filter according to the present embodiment. FIG. 31 is a cross-sectional view showing the filter according to the present embodiment. FIG. 31 corresponds to the line XXXI-XXXI of FIG. 30. FIG. 32 is a plan view showing the filter according to the present embodiment.

In a filter (a dielectric filter) 30 according to the present embodiment, the resonators 10, one of which is described above using FIGS. 4 to 6, have been multi-staged. Although there is described here as an example the case where three stages of the resonators 10 have been configured, the present embodiment is not limited to this.

As shown in FIGS. 30 to 32, in the present embodiment, three of the structures 16 are provided. As mentioned above, the structure 16 includes: the upper strip line 18A facing the upper shielding conductor 12A; and the lower strip line 18B facing the lower shielding conductor 12B. The structure 16 further includes the via electrode portion 20 which is formed inside the dielectric substrate 14, and is formed from the upper strip line 18A to the lower strip line 18B. Note that sizes of each of configuring elements of the three structures 16 are appropriately set such that desired electrical characteristics are obtained. Moreover, a configuration may be adopted whereby an unillustrated pattern is appropriately provided between each of the structures 16.

In this way, a plurality of the resonators 10 may be appropriately employed to configure the filter 30. Since resonators 10 with a good Q-factor are employed, a filter 30 with good characteristics can be obtained.

Note that although there has been described here as an example the case where the resonators 10, one of which is shown in FIG. 4, are multi-staged, the present embodiment is not limited to this. The resonators 10 shown in FIGS. 1 to 3, and FIGS. 7A to 14 may be configured multi-staged.

The above-described embodiments may be summarized as follows.

A resonator (10) includes: a via electrode portion (20) formed inside a dielectric substrate (14); a plurality of shielding conductors (12A, 12B, 12Ca, 12Cb) formed in the dielectric substrate so as to surround the via electrode portion; a first strip line (18A) which is connected to one end of the via electrode portion and faces a first shielding conductor (12A) among the plurality of shielding conductors, inside the dielectric substrate; and a second strip line (18B) which is connected to the other end of the via electrode portion and faces a second shielding conductor (12B) among the plurality of shielding conductors, inside the dielectric substrate. In such a configuration, the first strip line facing the first shielding conductor is connected to one end of the via electrode portion, and the second strip line facing the second shielding conductor is connected to another end of the via electrode portion. Due to such a configuration, sufficient current can be concentrated in a vicinity of a center of the via electrode portion, while preventing a local concentration of current in the first shielding conductor and the second shielding conductor from occurring. Hence, due to such a configuration, a resonator with a good Q-factor can be obtained.

The via electrode portion configures a $\lambda/2$ resonator in conjunction with the first strip line and the second strip line.

A configuration may be adopted whereby a first input/output terminal (22A) and a second input/output terminal (22B) are coupled to the first shielding conductor. Such a configuration also enables a resonator with a good Q-factor to be obtained.

A configuration may be adopted whereby the first input/output terminal and the second input/output terminal are electrically continuous with the first shielding conductor. Such a configuration also enables a resonator with a good Q-factor to be obtained.

A configuration may be adopted whereby the first input/output terminal and the second input/output terminal are not electrically continuous with the first shielding conductor, the first shielding conductor and the first input/output terminal are capacitively coupled via a first gap (26*a*), and the first shielding conductor and the second input/output terminal are capacitively coupled via a second gap (26*b*). Due to such a configuration, external Q can be adjusted by appropriately setting a capacitance formed by the first gap and a capacitance formed by the second gap.

A configuration may be adopted whereby a first input/output terminal and a second input/output terminal are coupled to the first strip line. Such a configuration also enables a resonator with a good Q-factor to be obtained.

A configuration may be adopted whereby the first input/output terminal and the second input/output terminal are electrically continuous with the first strip line. Such a configuration also enables a resonator with a good Q-factor to be obtained.

A configuration may be adopted whereby the first input/output terminal and the second input/output terminal are not electrically continuous with the first strip line, the first strip line and the first input/output terminal are capacitively coupled via a first gap, and the first strip line and the second input/output terminal are capacitively coupled via a second gap. Due to such a configuration, external Q can be adjusted by appropriately setting a capacitance formed by the first gap and a capacitance formed by the second gap.

A configuration may be adopted whereby a first input/output terminal and a second input/output terminal are coupled to the via electrode portion. Such a configuration also enables a resonator with a good Q-factor to be obtained.

A configuration may be adopted whereby the first input/output terminal and the second input/output terminal are electrically continuous with the via electrode portion. Such a configuration also enables a resonator with a good Q-factor to be obtained.

A configuration may be adopted whereby the first input/output terminal and the second input/output terminal are not electrically continuous with the via electrode portion, the via electrode portion and the first input/output terminal are capacitively coupled via a first gap, and the via electrode portion and the second input/output terminal are capacitively coupled via a second gap. Due to such a configuration, external Q can be adjusted by appropriately setting a capacitance formed by the first gap and a capacitance formed by the second gap.

A configuration may be adopted whereby the via electrode portion is configured from a single via electrode (24). Such a configuration also enables a resonator with a good Q-factor to be obtained.

A configuration may be adopted whereby the via electrode portion is configured from a plurality of via electrodes. Such a configuration also enables a resonator with a good Q-factor to be obtained.

A configuration may be adopted whereby the plurality of via electrodes are arranged along an imaginary circle (36), an imaginary ellipse (37), an imaginary track shape (38), an imaginary polygon (40), an imaginary circular arc (42), or an imaginary straight line (44), when viewed from an upper surface. Such a configuration also enables a resonator with a good Q-factor to be obtained.

A configuration may be adopted whereby the via electrode portion includes a first via electrode portion (20A) and a second via electrode portion (20B) that are formed adjacently. Such a configuration also enables a resonator with a good Q-factor to be obtained.

A configuration may be adopted whereby the first via electrode portion is configured from a plurality of first via electrodes (24*a*), the second via electrode portion is configured from a plurality of second via electrodes (24*b*), no other via electrode portion exists between the first via electrode portion and the second via electrode portion, the plurality of first via electrodes are arranged along a first imaginary curved line (46*a*), when viewed from an upper surface, and the plurality of second via electrodes are arranged along a second imaginary curved line (46*b*), when viewed from an upper surface. Due to such a configuration, since no other via electrode portion exists between the first via electrode portion and the second via electrode portion, a time required for forming the vias can be shortened, and, consequently, an improvement in throughput can be achieved. Moreover, due to such a configuration, since no other via electrode portion exists between the first via electrode portion and the second via electrode portion, a material such as silver embedded in the vias may be reduced, and, consequently, a reduction in costs can be also achieved. Moreover, since a region where an electromagnetic field is comparatively sparse is formed between the first via electrode portion and the second via electrode portion, it is also possible for a pattern for coupling adjustment, and so on, to be formed in the region.

A configuration may be adopted whereby the first curved line and the second curved line configure parts of a profile line of an imaginary ellipse or an imaginary track shape. Such a configuration also enables a resonator with a good Q-factor to be obtained.

A filter (30) includes the resonator of the above-described kind.

REFERENCE SIGNS LIST

10: resonator
12A: upper shielding conductor
12B: lower shielding conductor
12Ca: first side surface shielding conductor
12Cb: second side surface shielding conductor
14: dielectric substrate
16: structure
18A, 18B: strip line
20: via electrode portion
20A: first via electrode portion
20B: second via electrode portion
22A: first input/output terminal
22B: second input/output terminal
24*a*: first via electrode
24*b*: second via electrode
26*a*: first gap
26*b*: second gap
30: filter
32*a*: first connection line
32*b*: second connection line
34A: first λ/2 resonator
34B: second λ/2 resonator
36: imaginary circle
37: imaginary ellipse
38: imaginary track shape
40: imaginary polygon
42: imaginary circular arc
44: imaginary straight line
45*a*, 46*a*: first imaginary curved line
45*b*, 46*b*: second imaginary curved line

The invention claimed is:

1. A resonator comprising:

a via electrode portion formed inside a dielectric substrate;

a plurality of shielding conductors formed in the dielectric substrate so as to surround the via electrode portion;

a first strip line which is connected to one end of the via electrode portion and faces a first shielding conductor among the plurality of shielding conductors, inside the dielectric substrate; and a second strip line which is connected to another end of the via electrode portion and faces a second shielding conductor among the plurality of shielding conductors, inside the dielectric substrate, wherein the via electrode portion configures a λ/2 resonator in conjunction with the first strip line and the second strip line.

2. The resonator according to claim 1, wherein a first input/output terminal and a second input/output terminal are coupled to the first shielding conductor.

3. The resonator according to claim 2, wherein the first input/output terminal and the second input/output terminal are electrically continuous with the first shielding conductor.

4. The resonator according to claim 2, wherein the first input/output terminal and the second input/output terminal are not electrically continuous with the first shielding conductor, the first shielding conductor and the first input/output terminal are capacitively coupled via a first gap, and the first shielding conductor and the second input/output terminal are capacitively coupled via a second gap.

5. The resonator according to claim 1, wherein a first input/output terminal and a second input/output terminal are coupled to the first strip line.

6. The resonator according to claim 5, wherein the first input/output terminal and the second input/output terminal are electrically continuous with the first strip line.

7. The resonator according to claim 5, wherein the first input/output terminal and the second input/output terminal are not electrically continuous with the first strip line, the first strip line and the first input/output terminal are capacitively coupled via a first gap, and the first strip line and the second input/output terminal are capacitively coupled via a second gap.

8. The resonator according to claim 1, wherein a first input/output terminal and a second input/output terminal are coupled to the via electrode portion.

9. The resonator according to claim 8, wherein the first input/output terminal and the second input/output terminal are electrically continuous with the via electrode portion.

10. The resonator according to claim 8, wherein the first input/output terminal and the second input/output terminal are not electrically continuous with the via electrode portion, the via electrode portion and the first input/output terminal are capacitively coupled via a first gap, and the via electrode portion and the second input/output terminal are capacitively coupled via a second gap.

11. The resonator according to claim 1, wherein the via electrode portion is configured from a single via electrode.

12. The resonator according to claim 1, wherein the via electrode portion is configured from a plurality of via electrodes.

13. The resonator according to claim 12, wherein the plurality of via electrodes are arranged along an imaginary circle, an imaginary ellipse, an imaginary track shape, an imaginary polygon, an imaginary circular arc, or an imaginary straight line, when viewed from an upper surface.

14. The resonator according to claim 12, wherein the via electrode portion includes a first via electrode portion and a second via electrode portion that are formed adjacently.

15. The resonator according to claim 14, wherein the first via electrode portion is configured from a plurality of first via electrodes, the second via electrode portion is configured from a plurality of second via electrodes, no other via electrode portion exists between the first via electrode portion and the second via electrode portion, the plurality of first via electrodes are arranged along a first imaginary curved line, when viewed from an upper surface, and the plurality of second via electrodes are arranged along a second imaginary curved line, when viewed from an upper surface.

16. The resonator according to claim 15, wherein the first curved line and the second curved line configure parts of a profile line of an imaginary ellipse or an imaginary track shape.

17. A filter comprising a resonator, wherein the resonator comprises a via electrode portion formed inside a dielectric substrate, a plurality of shielding conductors formed in the dielectric substrate so as to surround the via electrode portion, a first strip line which is connected to one end of the via electrode portion and faces a first shielding conductor among the plurality of shielding conductors, inside the dielectric substrate, and a second strip line which is connected to another end of the via electrode portion and faces a second shielding conductor among the plurality of shielding conductors, inside the dielectric substrate, wherein the via electrode portion configures a $\lambda/2$ resonator in conjunction with the first strip line and the second strip line.

* * * * *